United States Patent [19]

Harper

[11] Patent Number: 5,036,952

[45] Date of Patent: Aug. 6, 1991

[54] LOAD LIFT TRUCK

[76] Inventor: Clark N. Harper, 8814 Oak Valley Dr., Sandy, Utah 84093

[21] Appl. No.: 312,119

[22] Filed: Feb. 17, 1989

[51] Int. Cl.[5] ..... B66B 9/20

[52] U.S. Cl. ..... 187/9 E; 414/631; 414/665; 414/667

[58] Field of Search ..... 187/9 R, 9 E, 95; 414/631, 666, 667, 665, 669, 670, 671, 672

[56] References Cited

U.S. PATENT DOCUMENTS

| | | | |
|---|---|---|---|
| 2,900,099 | 8/1959 | Cook | 187/9 R |
| 3,096,896 | 7/1963 | Norton et al. | 414/670 |
| 3,907,141 | 9/1975 | Ahrendt et al. | 187/9 R |
| 3,937,346 | 2/1976 | Lean | 187/9 E |
| 3,984,019 | 10/1976 | Brudi et al. | 414/666 |
| 4,033,471 | 7/1977 | Warner | 414/667 |
| 4,218,170 | 8/1980 | Goodacre | 414/666 |
| 4,392,773 | 7/1983 | Johannson | 414/667 |
| 4,395,188 | 7/1983 | Kaup | 414/622 |
| 4,439,102 | 3/1984 | Allen | 414/633 |
| 4,505,635 | 3/1985 | Shinoda et al. | 414/667 |
| 4,507,041 | 3/1985 | Church et al. | 414/641 |
| 4,520,903 | 6/1985 | Arnold et al. | 187/9 R |
| 4,523,886 | 6/1985 | Reeves | 414/641 |
| 4,533,290 | 8/1985 | Hackauf | 414/667 |
| 4,538,954 | 9/1985 | Luebke | 414/633 |
| 4,540,330 | 9/1985 | Taylor | 414/641 |
| 4,541,769 | 9/1985 | Clemens | 414/633 |
| 4,580,650 | 4/1986 | Matsuda | 180/89.1 |
| 4,607,997 | 8/1986 | Asaro | 414/667 |
| 4,632,630 | 12/1986 | Maki et al. | 414/700 |
| 4,643,628 | 2/1987 | Pini | 414/279 |
| 4,657,471 | 4/1987 | Shinoda et al. | 414/663 |
| 4,660,406 | 4/1987 | Rugh et al. | 72/468 |
| 4,668,154 | 5/1987 | Ueno et al. | 414/607 |
| 4,675,827 | 6/1987 | Narita et al. | 364/478 |

FOREIGN PATENT DOCUMENTS

| | | | |
|---|---|---|---|
| 3117803 | 11/1982 | Fed. Rep. of Germany | 414/631 |
| 1159708 | 7/1969 | United Kingdom | 414/631 |

OTHER PUBLICATIONS

Lansing brochure FRER 9.1. Copyright 1983.
Lansing brochure FRER 6.1. Copyright 1983.
Lansing brochure FAER 5.3. Copyright 1985.
Lansing brochure FRER 9.1. Copyright 1986.

*Primary Examiner*—Robert P. Olszewski
*Assistant Examiner*—Kenneth Noland
*Attorney, Agent, or Firm*—Trask, Britt & Rossa

[57] ABSTRACT

A load lift truck having a vertically extendible mast adapted for longitudinal displacement along a length of the truck chassis is disclosed. The truck includes a carriage mounted on the mast adapted for lateral displacement along the mast. The carriage fitted with a loadcarrying fork arrangement is adapted for angular rotation about a vertical axis. The truck is adapted for simultaneous operation of each of the aforesaid displacements and rotation thereby providing a means of maneuvering a load within a markedly smaller spatial environment with increased load.

11 Claims, 20 Drawing Sheets

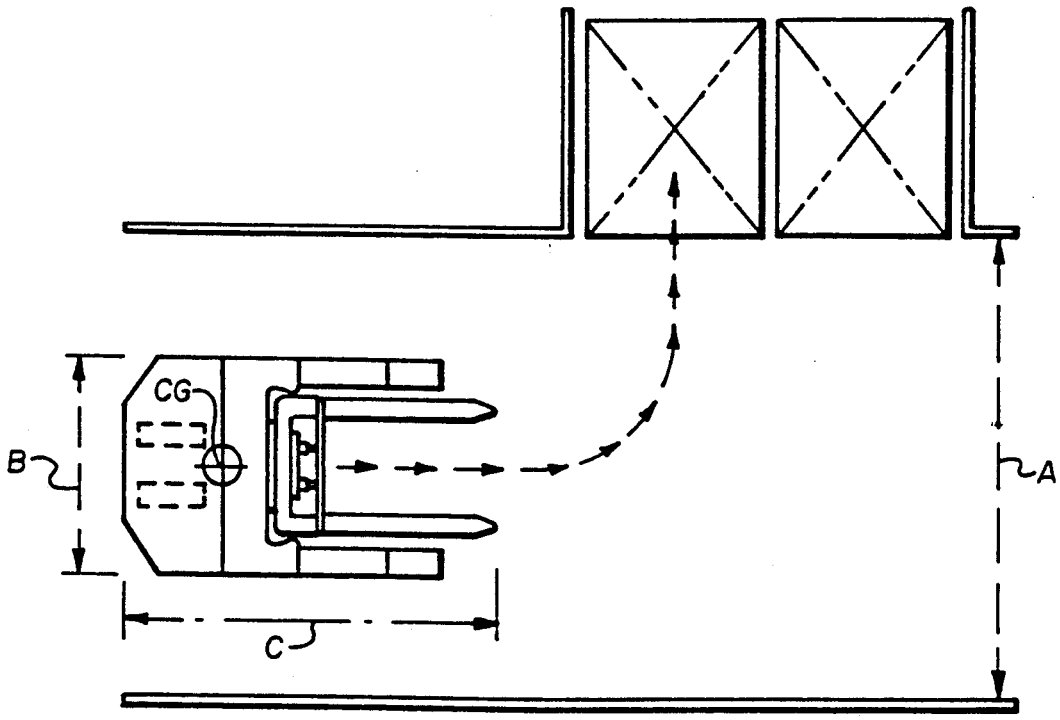
PRIOR ART Fig. 1
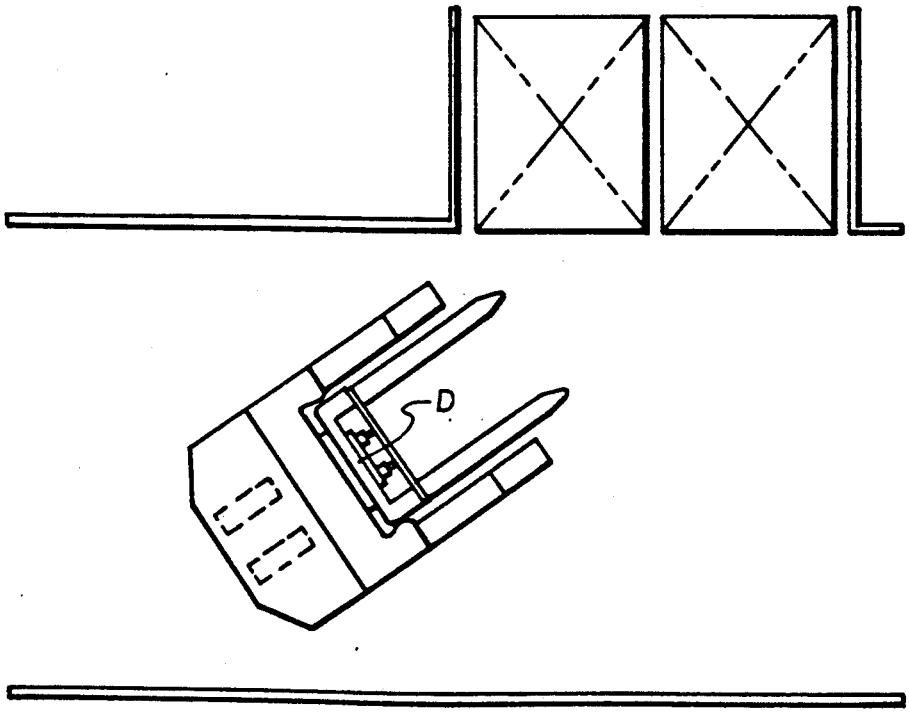
PRIOR ART Fig. 2

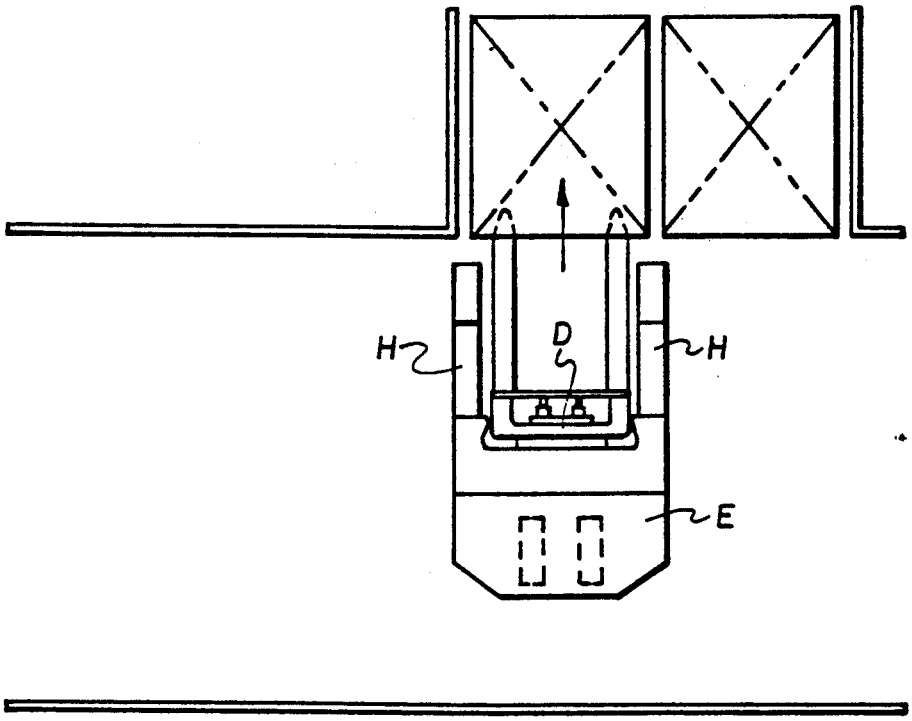
PRIOR ART Fig. 3
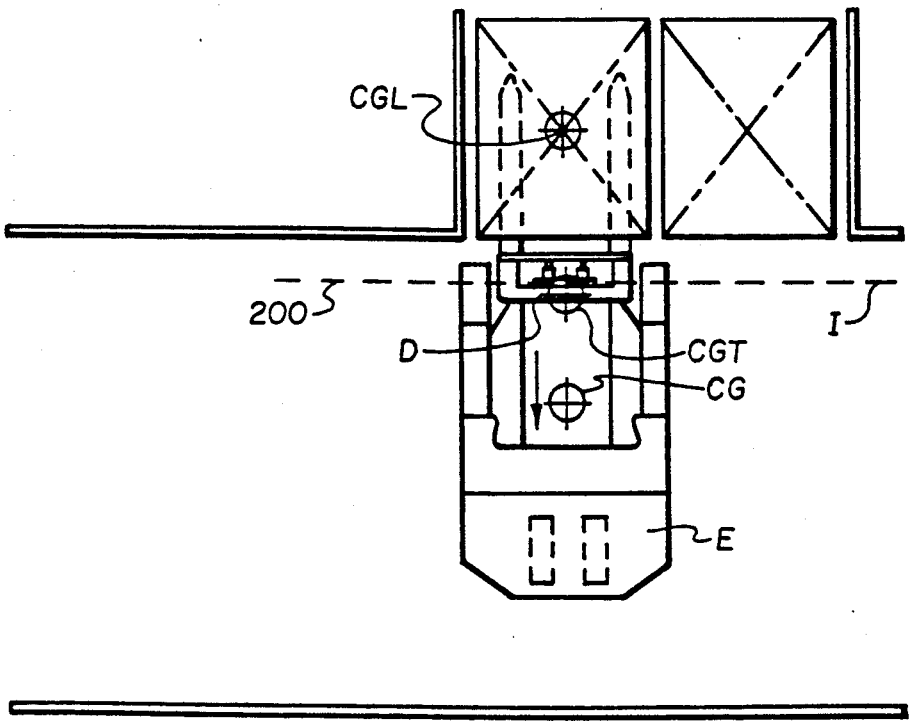
PRIOR ART Fig. 4

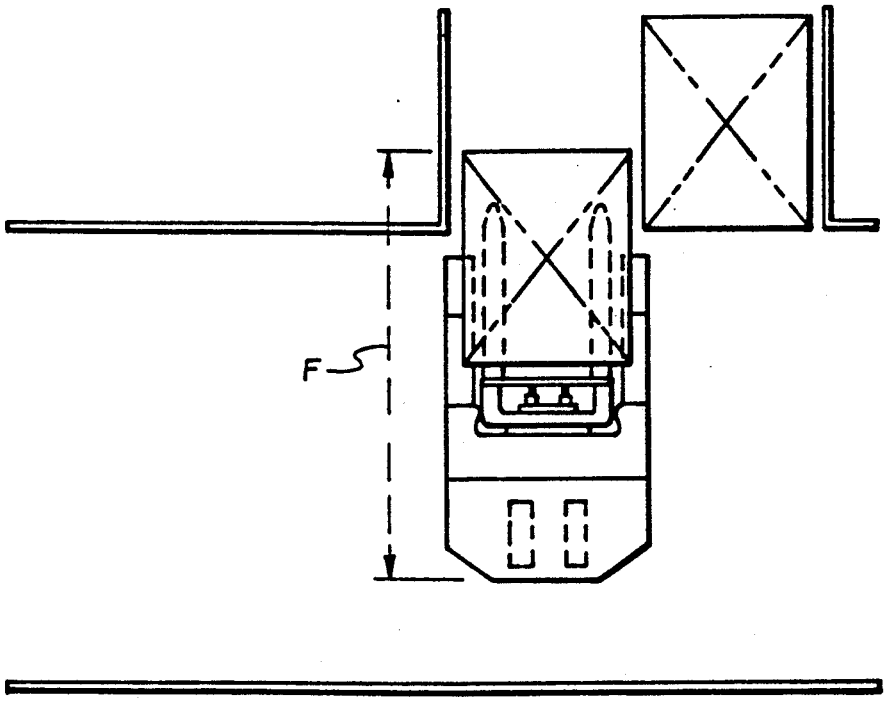
PRIOR ART Fig. 5
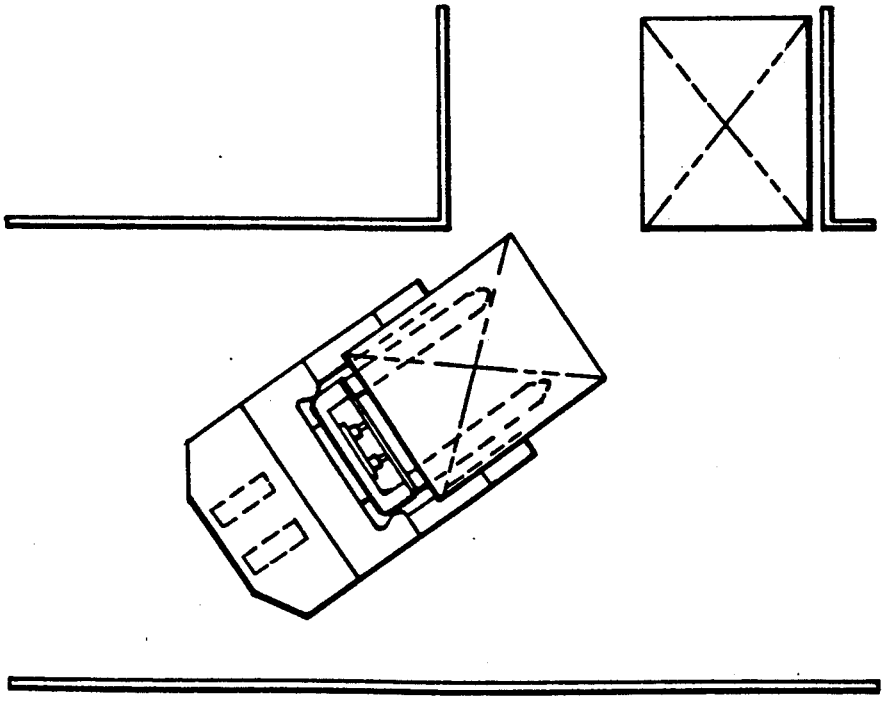
PRIOR ART Fig. 6

Fig. 7
PRIOR ART
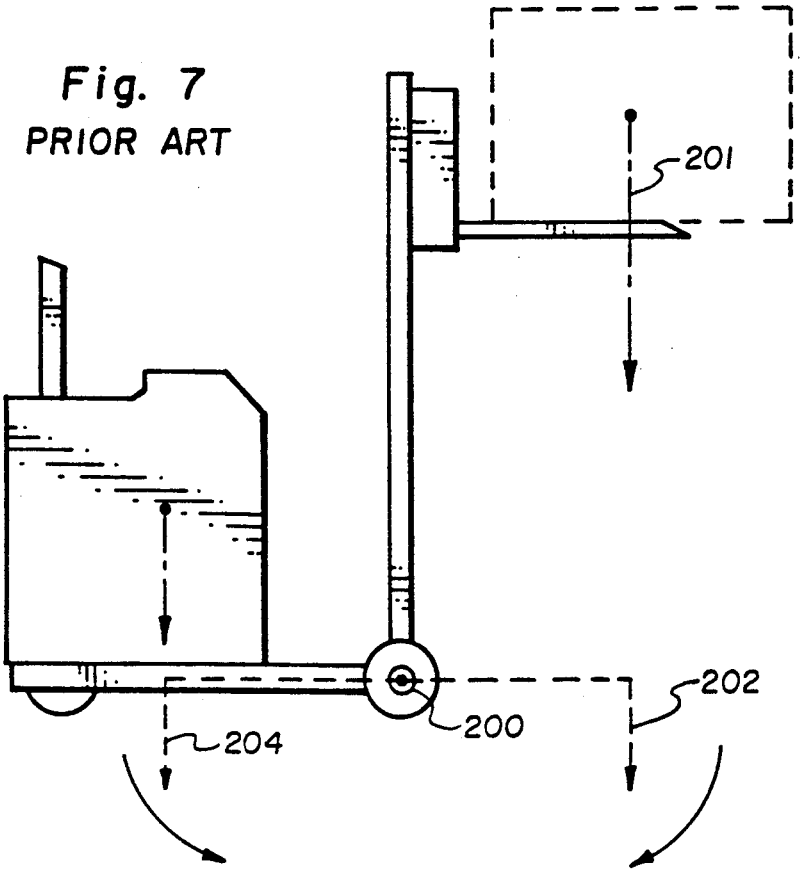
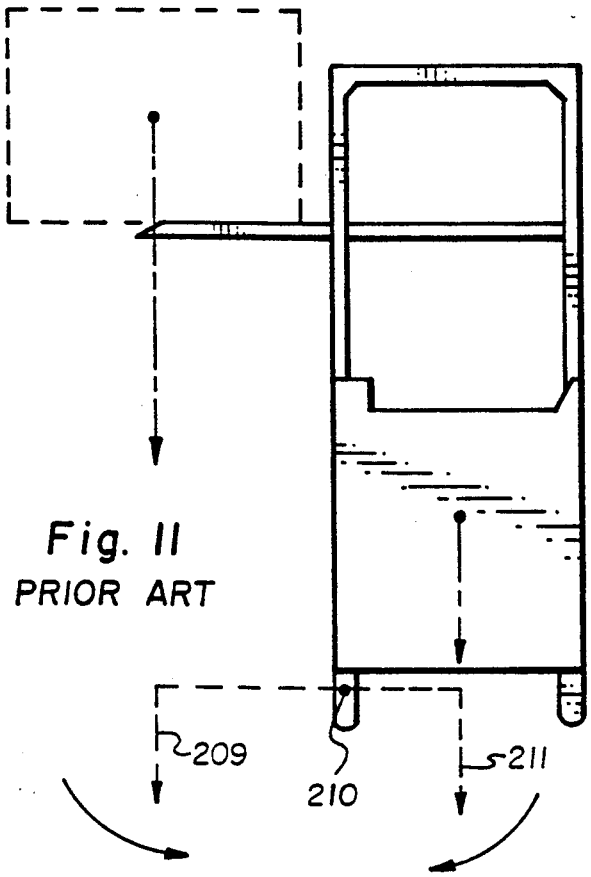
Fig. 11
PRIOR ART

PRIOR ART

LOAD LIFT TRUCK

BACKGROUND OF THE INVENTION

1. Field:

This invention relates to load carrying apparatus. More particularly, this invention is directed to load lifting trucks.

2. State of the Art:

Modern day storage facilities place a premium value on the use of physical space within such facilities. In order to optimize the use of space, such facilities are conventionally organized to include a plurality of rows of pallet racking on which articles are stored. Each pair of rows is separated by an aisleway dimensioned to permit a warehouseman to pass therethrough in order to access articles located in one or the other of the opposing rows of pallet racking. It follows that economy dictates that space within a warehouse should be allocated firstly to actual storage, with space allocated to aisleways being minimized to only that required for actual passage of a lift truck.

Lift trucks of various configurations are known in the art. Conventionally, trucks include an extendible mast having a pair of outwardly extending forks mounted thereon adapted to engage, lift and otherwise convey an article to be transported. Recently, efforts have been made to modify the function of the mast to achieve enhanced operational capabilities. For example, in one type of lift truck, known as a rolling mast reach truck, the mast has been made longitudinally displaceable along the length of the truck. In other configurations, the forks have been displaceably mounted for movement laterally across the face of the mast. Each of these various mast constructions include advantages as well as disadvantages, owing to their particular operation and structure.

A conventional rolling mast-type reach truck is shown in FIGS. 1–6, positioned within a aisleway of a storage facility. Observably, the figures are not drawn to scale. The aisleway is dimensioned to have a width considerably in excess of the width of the truck, due to the necessity of providing space for the truck to maneuver into a position where it can engage, load and retract an article to be transported. In order to properly load an article onto the truck, the truck must be aligned squarely with the article. The path of a truck preparing to load an article is shown by a dotted line in FIG. 1. As shown, the truck travels longitudinally down the aisleway. It begins to turn to the left until it aligns itself squarely with the article to be loaded. Observably, this maneuver requires the aisleway to have a width (A) which is not only broader than the width (B) of the truck, but furthermore, the width (A) must be dimensionally longer than the length (C) of the truck. The width (A) must be sufficiently large to permit the truck to back up from its abutment or loading and maneuver into a position whereby the operator can drive the truck longitudinally down the aisleway.

Upon the truck reaching the condition shown in FIG. 3, the mast (D) of the truck is extended longitudinally from the truck (as shown by the arrows), thereby urging the forks under the article to be loaded.

Thereafter, the mast (D) of the truck is raised sufficiently to elevate the forks and thereby raise the article and effectively load it on the forks (FIG. 4). Thereafter, the mast is retracted toward the truck chassis (E), as shown by the arrows, bringing the loaded article with it. As shown in FIG. 4, the article and mast are retracted to a position proximate the truck chassis. Subsequently, the truck must re-execute the aforedescribed maneuver in reverse in order to bring the truck into an orientation which permits its travel down the aisleway.

As shown in FIG. 5, oftentimes the dimensions of the articles to be transported measurably increase the effective length of the lift truck after the article is loaded on the truck's forks. See length indicated generally as (F). Naturally, this increase in length due to the contribution of the article must be accounted for in determining the required width (A) of the aisleway. Oftentimes, the combined length of the truck in association with its loaded article dictate the dimensioning of an aisleway which is exceedingly wide.

One of the most critical aspects of a lift truck is its load carrying capacity. This capacity is in large part predicated on the particular geometry and function of the truck itself. For example, the truck shown in FIGS. 1–6 includes a pair of outriggers (H) which extend outwardly parallel one another longitudinally from the truck. Each outrigger engages the ground by means of a wheel mounted proximate the free end of the outrigger. When unloaded, the truck's center of gravity, identified generally by the notation (CG) is located proximate the main truck chassis as shown in FIGS. 1–6. As the forks are extended, that center of gravity is displaced longitudinally along the truck's length. When the truck actually lifts the article to be transported, the truck's center of gravity shifts dramatically toward the front of the truck as shown by the notation (CGT) in FIG. 4. If the center of gravity (CGT) shifts longitudinally beyond the point of the engagement of the outrigger wheels with the ground, indicated by plane identified by the dotted line (I), the truck is longitudinally unstable and will tip toward the loaded article and may eventually turn over. As a result, for a chassis having a given weight, the load carrying capacity of the truck is dependent on maintaining the (CGT) on the vehicle's side of the plane indicated by the dotted line (I) in FIG. 4.

Noticeably, the drawback of the conventional rolling mast truck is its requirement of relatively wide aisleways suited to permit the type of truck maneuvering necessary to orient the truck for loading and unloading an article to be transported. As previously discussed, the allocation of space for aisleways in storage facilities should preferably be minimized, since space allocated for aisleways reduces the quantity of space which may be used for storage. This follows, as a recognition that storage space, not aisleway space, is regarded as the prime and foremost priority in storage facilities.

FIGS. 8–10 illustrate the loading maneuvers of a conventional lateral turret lift truck. As shown in FIG. 8, a truck of this construction includes a pair of loading forks (J) which are oriented transverse of the longitudinal axis of the vehicle. The forks are mounted to a carriage and pivot head (K) which is constructed to be laterally displaceable along a structure (L) positioned on the front of the truck. The forks are made rotatable about the support, thereby permitting the forks to retrieve and load articles from either side of the vehicle. For example, the vehicle illustrated in FIGS. 8–10 is shown loading from the left side of the aisle, the truck could equally well load from the right side.

As shown in FIG. 8–10, the truck is driven to a location proximate the article to be loaded and the forks (J)

are aligned in register with the article. A lateral translation of the forks across the face of the truck urges the forks beneath the article (FIG. 9). A lateral reversal of the forks and its supporting carriage causes the article to be retracted outwardly from its storage location in a direction generally perpendicular to the longitudinal axis (M) of the aisleway. Noticeably, the width (A) of the aisleway is determined by the length (N) of the article in combination with the depth of the fork carriage and the associated pivot head (P).

As shown in FIG. 12, the turret truck may pivot the fork carriage so as to orient the article transported collinearly with the longitudinal axis of the truck. In doing so, the operator must typically retract the article completely out of the shelf location before initiating any pivoting motion. When the article is carried in this forward facing orientation, the moment created by the article transported on the truck is maximized due to the length of the effective moment arm ($R_2$).

There continues to be a need for a truck which requires a minimal quantity of aisle space for maneuvering during its loading and unloading operations. Further, there continues to be a need for a truck whose operation maximizes its load carrying capability.

SUMMARY OF THE INVENTION

The lift truck of the instant invention includes a chassis supported by one or more of ground engaging means, e.g., power driven wheels. The chassis includes at least one outwardly extending outrigger-type support which is supported above the ground on its free end by a wheel or other support means, e.g. a sled.

In a first embodiment, the outrigger support defines a guide track therein adapted for guiding an upright mast longitudinally along a length of that track. The mast, which may be of a vertically telescopically-extendible type, is mounted within the track by rolling means which permit a minimal drag translation of that mast along the track. A first drive means which may be a pressurized fluid cylinder, e.g., a hydraulic or pneumatic type, is mounted to the truck chassis and the mast. The first driving means is adapted for displacing the mast longitudinally along the chassis. The first drive means is dual-directionally-actuatable, thereby permitting an operator to drive the mast in either a forward or backward motion along the track.

The mast, if it is of an extendible type, includes a second drive means, e.g., a pressurized fluid cylinder adapted for drivingly extending and retracting the mast. Such means may include a pressurized fluid cylinder, a chain drive connected to an actuating motor which may be of an electric, gas, diesel, or liquid propane gas-type. Alternatively, any other means capable of translating the extension along the face of the support may be used. Fixedly mounted on the free end of that mast is a laterally extending support fitted with an outwardly extending arm. The support defines a guide track therein adapted for guiding the arm's lateral translation along the face of the support. The support includes a third drive means adapted for forcedly driving or shifting the arm laterally along the support. In preferred embodiments, the shifting means may include a dual-directioned pressure fluid cylinder which itself defines the guide track.

The arm is mounted on its outermost free end with a pivotedly mounted carriage having a plurality of outwardly extending load-carrying forks mounted thereon. The support may include a fourth drive means adapted for rotating the carriage, e.g., about a vertical axis. The third drive means may include a hydraulic motor, electric motor, pressurized fluid cylinder or other conventional system as its power generating means.

The forks on the carriage may include one or more powered tilting means attached thereto adapted for tilting the forks by applying a preselected directioned force application to those forks.

In operation, the association of the longitudinally displaceable mast, laterally translatable arm and rotationally mounted fork fitted carriage provides the operator with a means of transporting a load down an aisleway which is dimensioned to closely correspond with the width of the load. The first, second, third, and fourth drive means are adapted to be independently operated or alternatively, operated in conjunction one with another. Indeed, all four of the drive means can be operated simultaneously to yield a displacement of the load along a selected path. This capability to direct the load along a selected path provides two critical benefits to the invention. First, the operator is able to retrieve and deposit loads from or onto aisle shelf locations, utilizing a measurably smaller aisle space for maneuvering purposes. More specifically, the invention provides a lift truck having maneuvering capability utilizing four degrees of freedom. The association of multiple drive means allows the operator a four-way means of maneuvering the load during retraction and deposition. An operator of the invention can simultaneously displace the load longitudinally (either forward or away from the truck chassis), laterally and vertically and may further pivot the load about a vertical axis.

A utilization of all of these functions simultaneously, i.e., longitudinal displacement, lateral displacement pivoting and vertical displacement, provides the user with the capability to maneuver a load about a 90° angle while maintaining tight control over the location of the center of gravity of the load. This control permits the operator to shift the load from a forwardly facing load orientation to an orientation which is ninety degrees removed therefrom while maintaining the longitudinal and lateral stability of the loaded truck. The invention permits that shifting to be either to the left or the right. The configuration of the truck permits the operator to retain the center of gravity of the load during the unloading and loading maneuver, closer to the chassis, thereby minimizing the length of the movement arm of the load's center of gravity and as a result, maximizing the load carrying capability of the truck while optimizing stability. Further, this maneuvering capability permits an operation to optimize utilization of the geometry of the shelf space so as to minimize the amount of aisle space required for loading, transporting and unloading an article. The fork carriage of the invention may also be fitted with a tilting means adapted for tilting the carriage forks, thereby increasing the stability of an article loaded on those forks.

BRIEF DESCRIPTION OF THE DRAWINGS

FIG. 1 is a top plan view of a prior art rolling mast lift truck shown in an aisleway, preparing to engage a load to be lifted.

FIG. 2 is a top plan view of the lift truck of FIG. 1, reorienting itself to align its lift forks to register with the load.

FIG. 3 is a top plan view of the lift truck of FIG. 3 having its forks in register with the load.

FIG. 4 is a top plan view of the lift truck of FIG. 1 having its forks extended beneath the load.

FIG. 5 is a top plan view of the lift truck of FIG. 1 showing the truck retrieving the load from its shelved location.

FIG. 6 is a top plan view of the lift truck of FIG. 1 showing the truck reorienting itself in the aisle to permit its travel along the length of the aisleway.

FIG. 7 is a side view of the truck of FIG. 1.

FIG. 11 is an end view of the truck of FIG. 8.

DETAILED DESCRIPTION OF THE INVENTION

Figure 13:
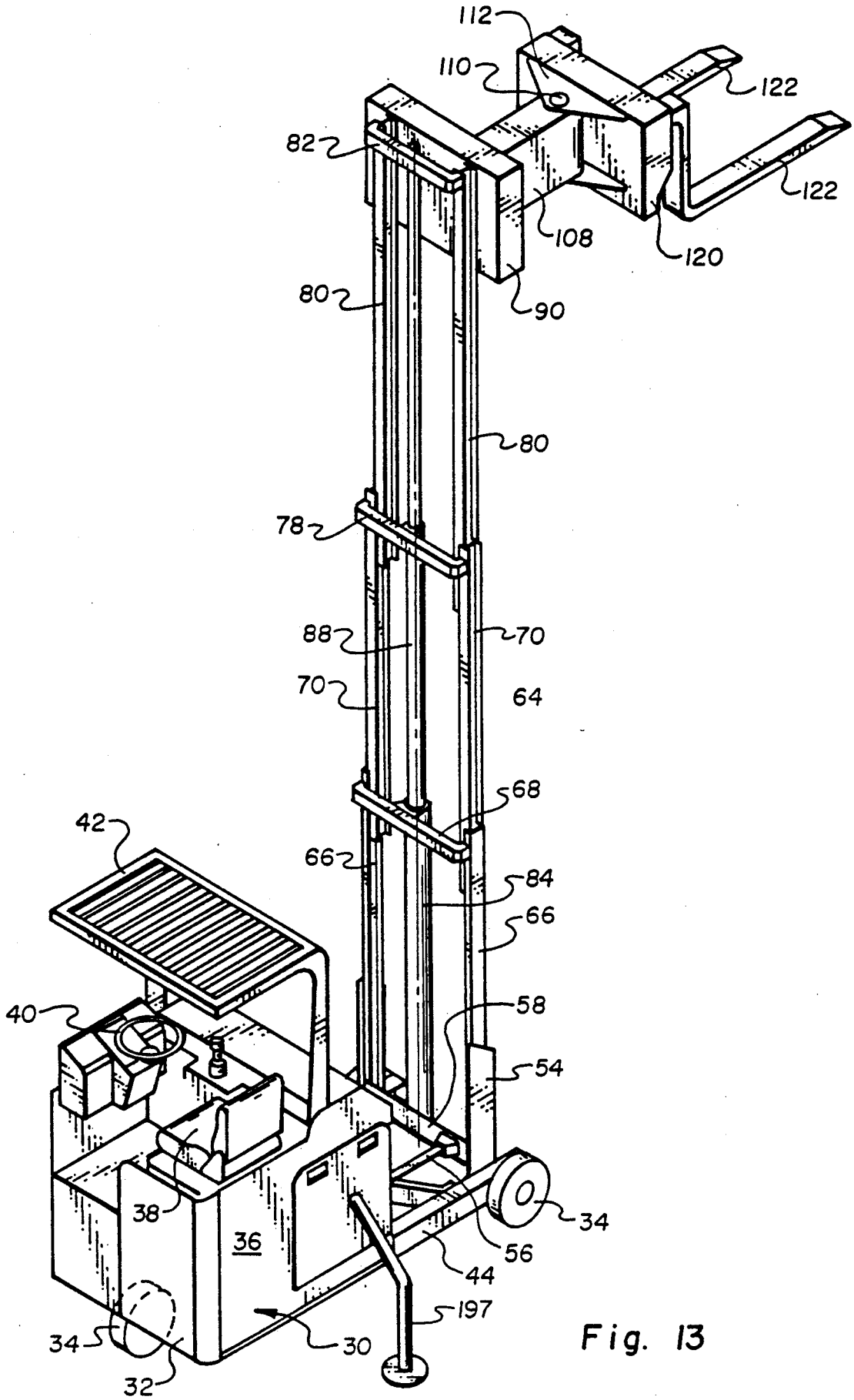
FIG. 13 is a perspective view of a preferred embodiment of the lift truck of the invention showing the lifting forks in an outwardly extending and the elevated orientation with the mast fully extended and the turret attachment fully extended.

The lift truck of the invention is illustrated in FIG. 13. The truck, generally 30, includes a chassis 32 which is supported by a plurality of wheels 34. While a three-wheel embodiment of the invention is illustrated, it should be understood that four-wheel constructions are also contemplated. The chassis 32 includes a box-like housing 36 which encloses the drive unit of the truck, which may be either an electric motor or an internal combustion engine. The truck includes a drive train which intercooperates the drive unit with one or more of the truck wheels 34. Various cooperation schemes for linking the drive unit to one or more drive wheels is contemplated. For example, the front wheels may be driven, alternatively the rear wheels may be driven.

A seat 38 for the truck's driver is mounted atop housing 36, the steering wheel 40 and other controls are mounted on a console positioned proximate seat 38. While a seat 38 is provided, it should be understood that the instant invention could also be configured in a stand-up embodiment, wherein the operator stands instead of sits. A protective cage-like structure 42 extends upwardly from the housing 36 to form a rigid protective structure about a driver seated on seat 38.

Figure 14:
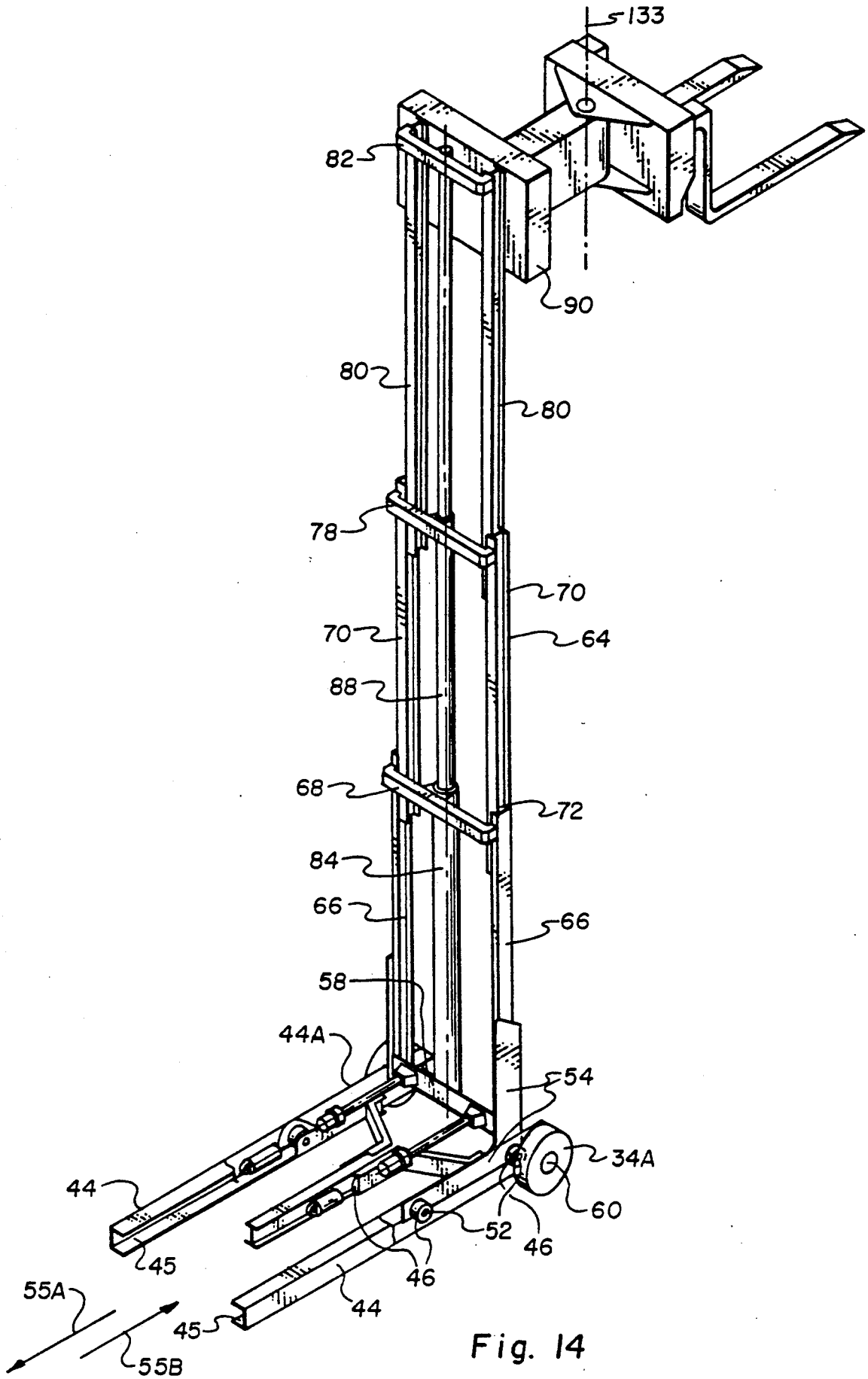
FIG. 14 is a perspective sectional view of the fork-fitted mast of the lift truck of FIG. 13.

Extending longitudinally from chassis 32 is a pair of elongate outrigger-like supports 44 which are shown more clearly in FIG. 14. The supports 44 are each formed of a structural member, e.g., a "U"-shaped, channel-defining stock. As illustrated in FIG. 14, each support 44 is oriented such that the open side of the support is oriented vertically to face the vertically-oriented open side of the opposing support 44. Each support 44 is a linear member. The interior of each support defines an elongate linear channel 45 which functions as a track for one or more wheels or rollers 46 mounted therein. The supports 44 are oriented parallel one another to define a track which extends longitudinally from the truck housing 36.

Each of the rollers 46 is journaled on a respective axle 52 which is fixedly mounted as a horizontally positioned mounting bracket 54. In FIG. 14, the roller 47 and mounting bracket 54 have been removed from the left-hand channel support 44A for clarity purposes. It should be understood, however, that the left-hand support is a mirror reflection of the right-hand support configuration. The bracket 54 is longitudinally displaceable along the length of supports 44 in either a forward and backward direction by the action of one or more pressurized fluid, rod-fitted cylinders 56. Recognizably, other drive configurations could be adapted, e.g. motor driven chain arrangement, a worm gear construction or alternatively, a rodless cylinder arrangement. The cylinders 56 may be of a hydraulic or pneumatic-type construction, and are each adapted for dual directional action, i.e., each cylinder is configured to apply both a pushing force as well as a pulling force on the bracket 54, with the particular direction at any one moment being determinable by the operator. The bracket 54 is therefore adapted for travel in the directions indicated by arrows 55A and 55B. The cylinders 56 are each mounted to a cross-brace 58 which interconnects the two brackets 54 and forms part of the bracket assembly.

As shown in FIG. 14, outrigger supports 44 include a pair of wheels 34A mounted thereon. Each wheel 34A is journaled on an axle 60 which is fixedly mounted to a respective support 44 proximate the free end thereof. The use of the wheels 34A provide a two-point support means for each support 44 and 46, i.e., the support mounting on chassis 32 and its mounting to wheel 34A.

Mounted to the upwardly extending sections of bracket 54 is a three segment mast arrangement 64 adapted for extension and telescopic or nesting retraction. Understandably, other mast constructions may be utilized. For example, masts of a single, double, quadruple or other multiple of extendible segments may likewise be employed. As shown in FIG. 14, the mast 64 includes a first pair of elongate, vertically upright, parallelly-positioned first extensions 66 which are spaced positioned apart from one another. Each extension 66 is fixedly mounted to bracket 54 proximate a respective end thereof to extend upwardly from that bracket 54. As shown, each first extension 66 is formed of a structural member, e.g., "U"-shaped channel stock. A cross-brace 68 is mounted to each of the first extensions 66 proximate the free ends thereof to extend therebetween. The cross-brace 68 operates to give a degree of integrity to the first extension arrangement.

A pair of elongate second extensions 70 are positioned spacedly apart vertically upright and parallel one another in a nesting or telescopic arrangement with the first extensions 66. As illustrated in FIG. 14, each extension 70 is formed of a structural member, e.g. "I"-beam type member. A flange of each "I"-beam contiguous extension 70 is received within a respective, vertically-oriented channel defined by a respective first extension 66. In this arrangement the second extension 70 is permitted upward as well as downward displacement along the first extension 66. As shown, a flange 72 of the first extension 66 likewise extends into an open channel 64 which extends vertically along the length of second extension 70. Spacers are positioned within the channels of each extension 66 and 70 to retain the two extensions fixed against displacement vis-a-vis each other in the directions indicated by arrows 55A and 55B. The extensions 66 and 70 are freely mounted vis-a-vis each other to permit a vertical extension of extension 70 vis-a-vis first extensions 66. A cross-brace 78 is mounted to each of the second extensions 70 to extend therebetween to add structural integrity to the two extensions.

A third pair of extensions identified generally as third extensions 80 are mounted in a nested or telescopic relationship with second extension 70. As shown in FIG. 14, each third extension 80 is an elongate linear structural member, e.g. a "I"-beam like member, having a flange thereof positioned and aligned within an upright, elongate channel defined within the structure of a respective second extension 70. This alignment operates as a track to guide the respective third extension in its upward and downward displacements relative to its respective proximate second extension 70. The two third extensions 80 are positioned spacedly apart, upright and parallel one another similarly to the previously described first and second extensions 66 and 70.

A cross-brace 82 is mounted to each third extension to extend therebetween, forming a bridge or linkage between the two third extensions, thereby adding structural rigidity and integrity to the third extension arrangement.

A fluid pressure actuated, two-segmented cylinder 84, of either the pneumatic or hydraulic type, is mounted to cross-brace 58. Cylinder 84 is oriented vertically upright. The free end of the cylinder rod 88 is fixedly mounted to cross-brace 82 whereby upon an initial pressurization of that cylinder 84, the third extensions 80 are elevated upwardly. The cylinder 84 may be a dual-directioned cylinder. Alternatively, a two-, three- or four-stage telescoping cylinder may be used.

Fixedly mounted to the free ends of the third extensions 80 is a laterally extending support 90. As shown to advantage in FIG. 15, support 90 forms a housing in which is mounted a horizontally oriented double-acting cylinder 92. The ends of the two rods 94 of the cylinder are fixedly mounted to the support 90, the cylinder housing 96 is adapted for translation along the length of the rods 94 in the directions indicated by arrows 98A and 98B upon a pressurization of the cylinder. A collar 100 fixedly mounted on the cylinder housing 96 is mounted with a hydraulic motor 102 having a vertically oriented drive shaft 104, mounted with a horizontally oriented toothed gear 106.

A support arm bracket 108 is mounted to the collar 100 and extends outwardly therefrom. The arm bracket 108 is adapted for lateral translation along a length of support 90 together with the cylinder 96. A vertically oriented pivot shaft 110 is journaled in the free end of support arm bracket 108. The shaft 110 is fixedly mounted at its ends to a pair of spacedly positioned, horizontally and parallelly oriented, carriage brackets 112. One bracket 112 is positioned above support bracket 108, the other bracket 112 is positioned below that bracket, whereby those brackets are free to rotate in a generally horizontal plane about an axis defined by pivot shaft 110. Pivot shaft 110 is fitted on its end with a toothed gear 114 around which is trained a pivot chain 116. Chain 116 is also trained about gear 106 to form an endless, continuous configuration. Carriage brackets 112 are each mounted to an upright carriage 120, which is shown as a laterally extending boxlike member. Pivotedly mounted to carriage 120, proximate an upper region thereof, are two generally "L"-shaped forks 122. The forks 122 are positioned spacedly apart from one another in a generally parallel orientation.

A pressurized fluid cylinder 126 is pivotedly mounted to each respective fork 122 proximate an angulated bend therein by means of a clevis-type bracket 128 and a pivot pin 130 which passes through registered apertures in that bracket and also through an eyelet-forming structure on the end of the rod 132 of the cylinder 126. The cylinder housing section 134 of pressure cylinder 126 is pivotally mounted to the carriage 120 by a similar pivot fitting which, though not shown, is known in the art.

In operation, the lift truck 30 of the invention admits of four distinct and separate means of displacing a load positioned on the forks 122. First, the cylinders 56 permit the operator to displace the mast formed by extensions 66, 70 and 80 in a forward and rearward longitudinal direction relative to the chassis 32 of the truck. Cylinder 84 permits the operator to raise or lower the mast vertically. Cylinder 92 operates to provide a lateral displacement of carriage 120 across the face of the support 90. Hydraulic motor 102 functions to permit a rotation of carriage 120 about a vertical axis 133. Tilt cylinders 126 may be utilized to tilt the forks 122 to retain the load in place.

An interaction of these four driving means permits the operator of the truck to achieve a loading and unloading maneuver which not only requires less operating space than prior existing trucks, but more importantly, the displacement path of the load-bearing forks 122 relative to the truck chassis is such that the displacement of the center of gravity of the load/fork carriage assembly relative to the chassis, i.e. the moment arm is constrained such that the moment arm length is considerably less than the moment arms in conventional lift truck configurations. This results in less of what is termed in the art as "lost load center." This particular feature of the instant truck results in an increase in the load carrying capability of the truck over conventional trucks, given a constant chassis mass for each of the compared trucks.

Figure 15:
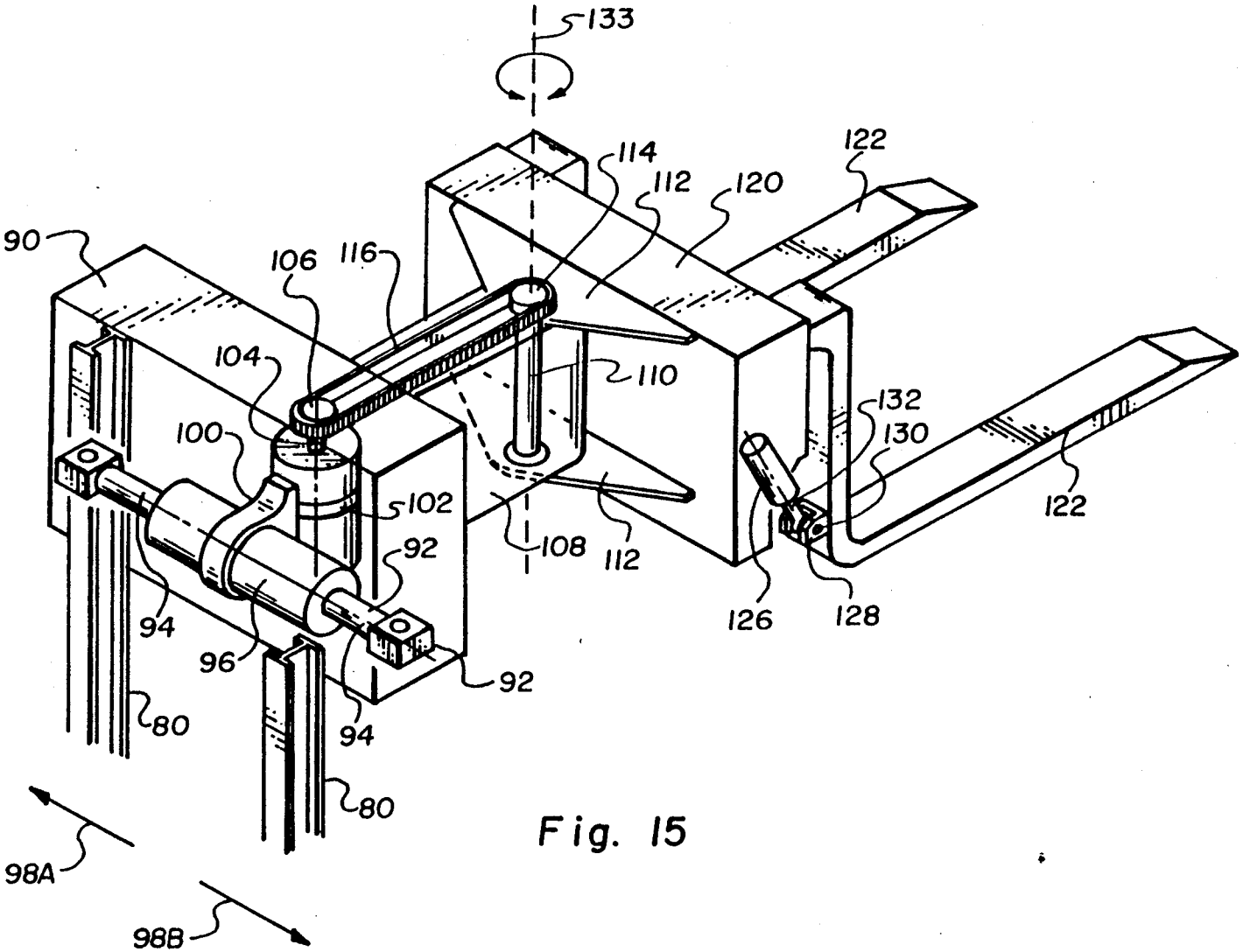
FIG. 15 is a perspective view of the lifting forks and separate carriage of a lift truck of the invention.

FIGS. 16–21 illustrate an alternative embodiment of the invention wherein the mast 57 is driven by one as opposed to two pressurized fluid cylinders 56. In this embodiment, the first, second and third mast extensions are formed of a structural member, e.g. "U"-shaped members which are nested one inside another. A respective pressurized fluid cylinder 84 is mounted in association with each leg of the mast 57. In contradistinction to the use of a dualactioned cylinder 96 in support 90 as shown in FIG. 15, this alternative embodiment of the invention includes two hydraulic motors 170 mounted upright in the support 90. Each motor 170 includes a toothed gear 172 fixedly mounted to each motor's drive shaft (see FIG. 20). An endless continuous drive chain 174 is trained about the two gears to form a drive track for the support arm bracket 108, which is fixedly mounted to that chain along a portion of a length thereof.

In other respects, the construction of the alternative embodiment parallels that of the embodiment described in the discussion of FIGS. 13–15.

Figure 16:
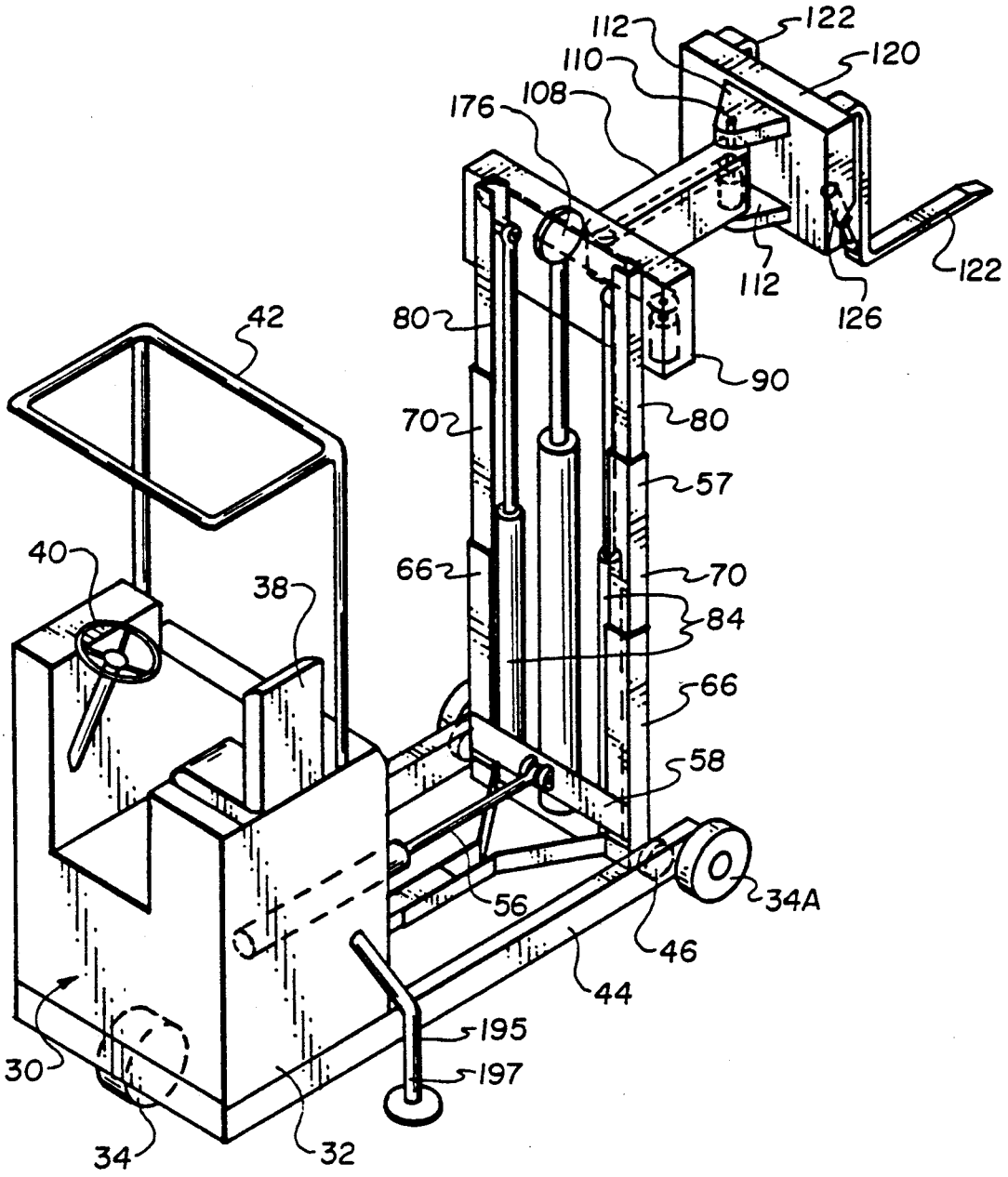
FIG. 16 is a perspective view of a second embodiment of the lift truck.
Figure 17:
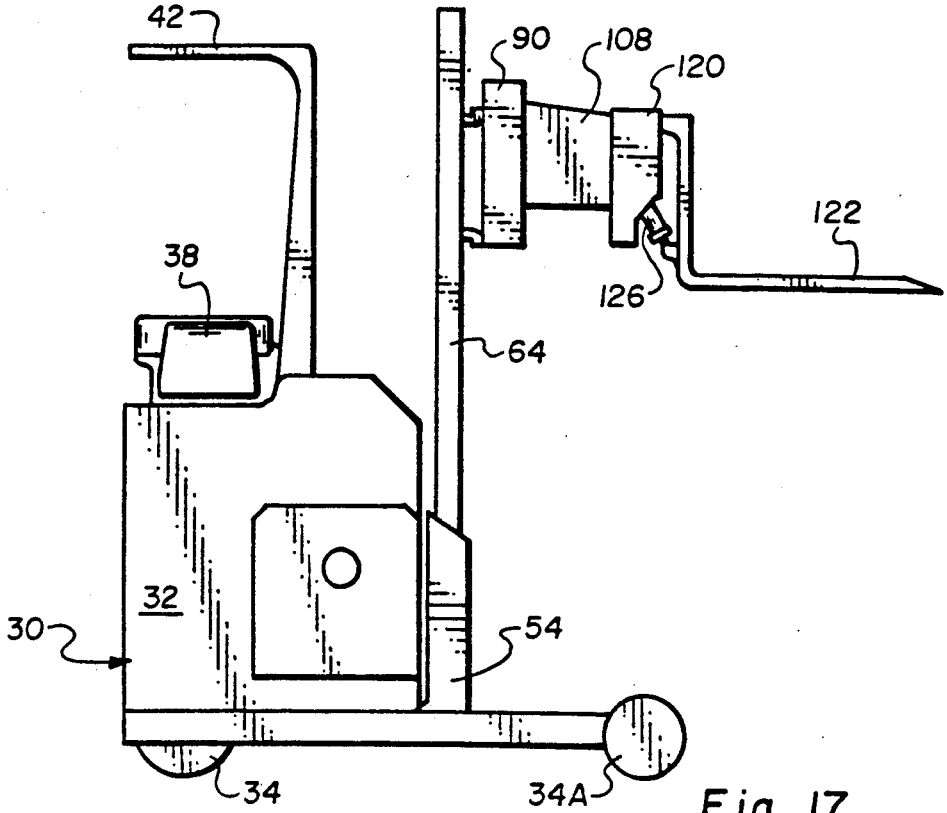
FIG. 17 is a side view of the lift truck shown in FIG. 16 with the mast in the retracted position.
Figure 21:
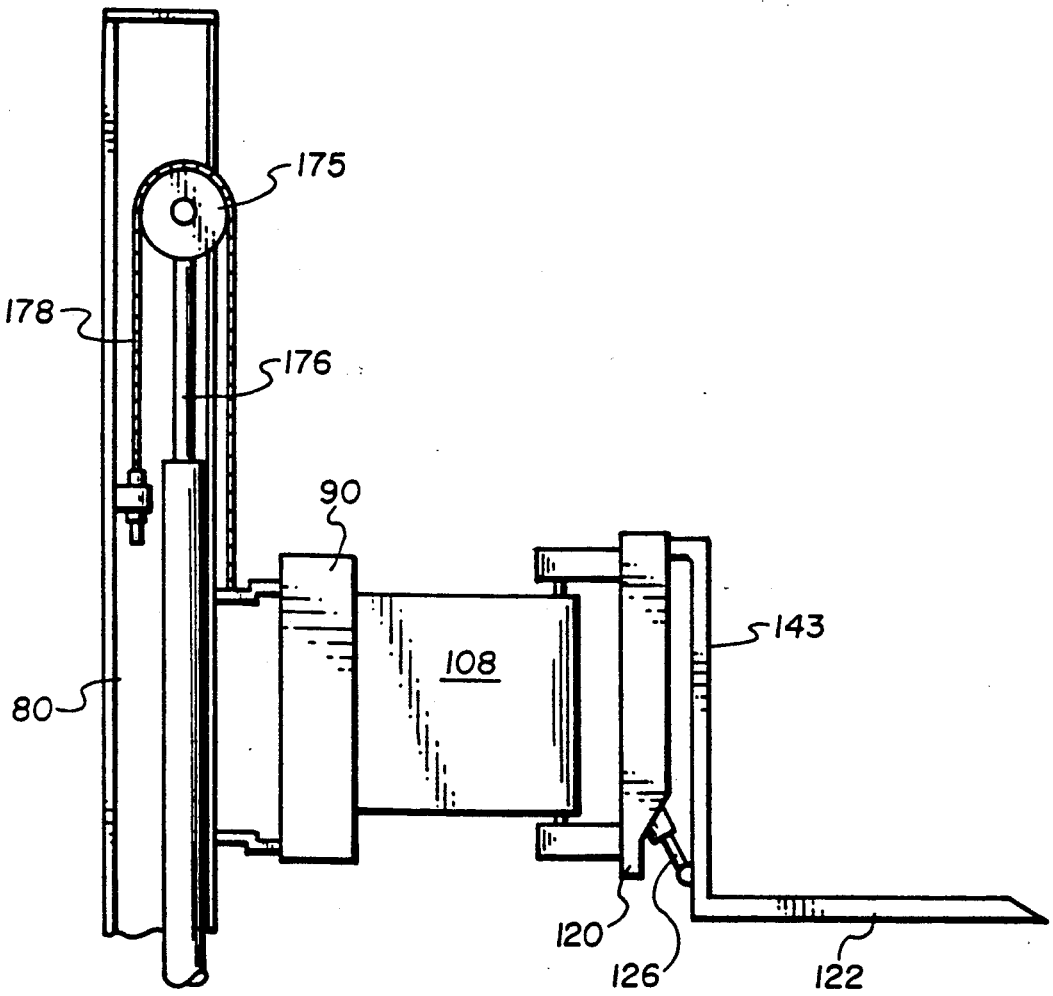
FIG. 21 is a side view of the forks and support carriage of the lift of FIG. 16.

FIG. 16 illustrates the use of a pressurized fluid cylinder 176 adapted for raising or lowering the support 90 relative to the mast 57. A more detailed illustration of the linkage associating that cylinder 176 with the carriage 120 is shown in FIG. 21. On each leg of mast 57 a chain 178 is fixedly mounted to the third extension 80 at its first end, and thereafter trained over an annular pulley 175 journaled on the rod of cylinder 176. The opposing end of the chain 178 is fixedly mounted to support 90, a displacement of the rod of cylinder 176 causing a corresponding displacement of the support 90.

Figure 22:
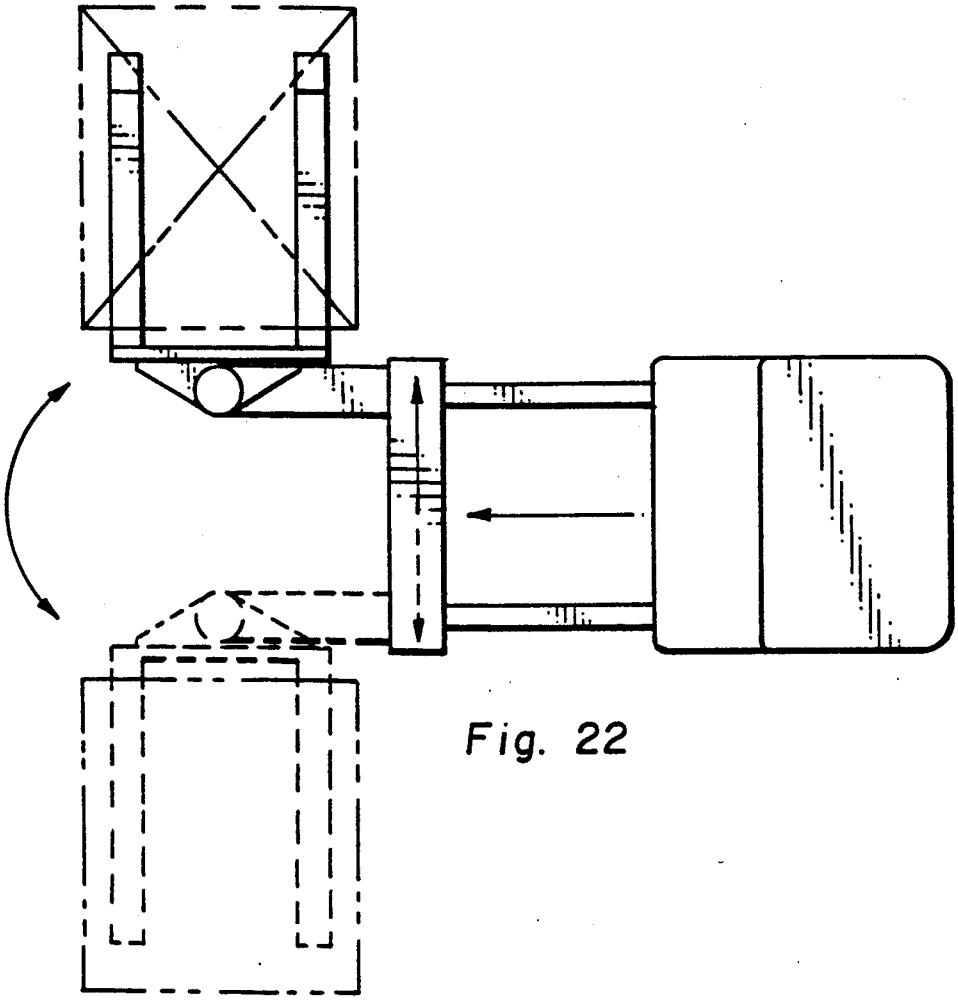
FIG. 22 is a top plan view of the lift truck of the invention having the mast extended and the forks rotated to the side and laterally extended.
Figure 23:
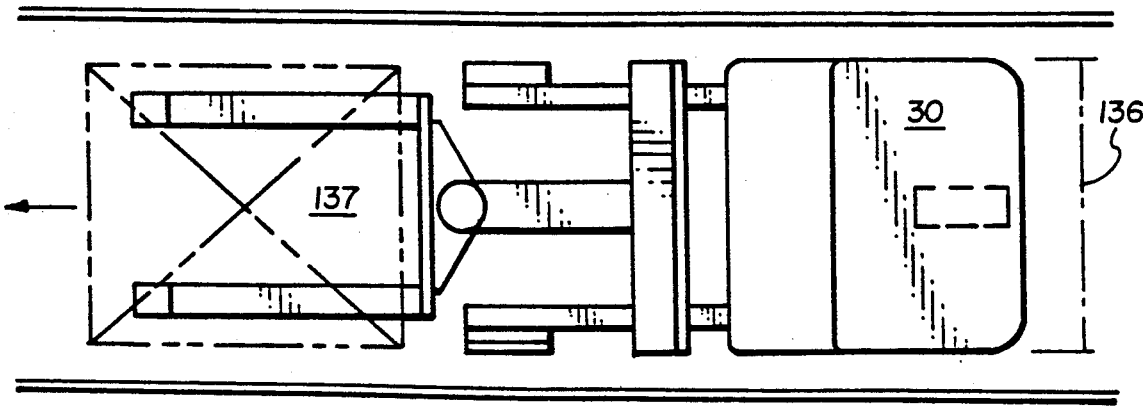
FIG. 23 is a top plan view of the lift truck of the invention with the forks oriented forward and positioned proximate the truck chassis.

For a better understanding of the features of the invention and the intercooperation of the various driving means of the truck, resort is made to FIGS. 22–23.

As shown in FIG. 23, the truck 30 of the invention may be effectively operated in an aisleway which is only slightly larger than the width 136 of the truck. In contrast, the prior art devices, illustrated in FIGS. 1–10, require an aisleway having a width far in excess of the width of the truck, as dictated by requirements for the trucks maneuvering to unload and load articles to be transported.

Figure 24:
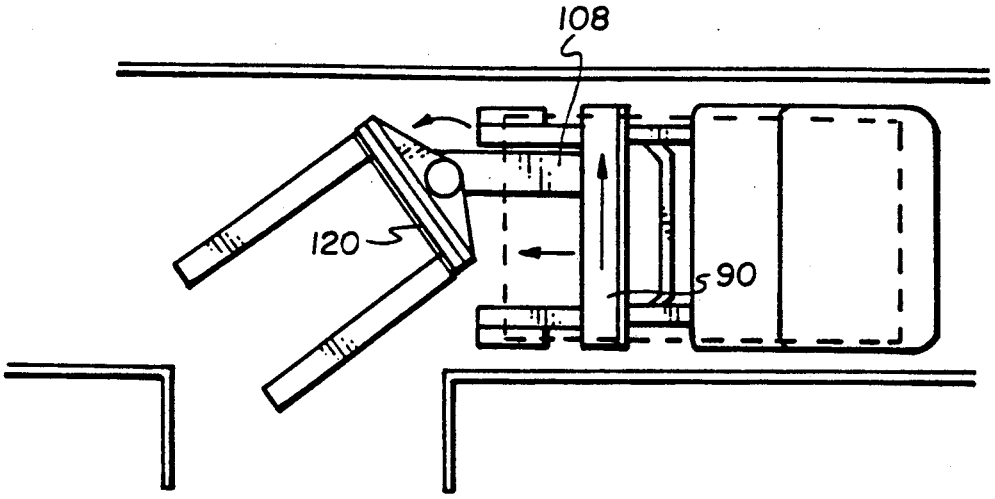
FIG. 24 is a top plan view of the truck of FIG. 23 showing the forks and support carriage being rotated counterclockwise. The carriage is also depicted as being laterally shifted. The mast is shown being extended forward (longitudinally). The aforesaid rotation, shifting and extension are indicated pictorially by arrows on the FIG.

As shown in FIG. 24, upon the truck reaching the location of an article to be loaded, depending on whether the load is on the left hand or the right hand of the truck, the support bracket 108 is shifted laterally across support 90 while simultaneously the carriage 120 is rotated about pivot shaft 110 by motor 102. Simultaneously, the mast is extended outward longitudinally away from the truck chassis.

Figure 25:
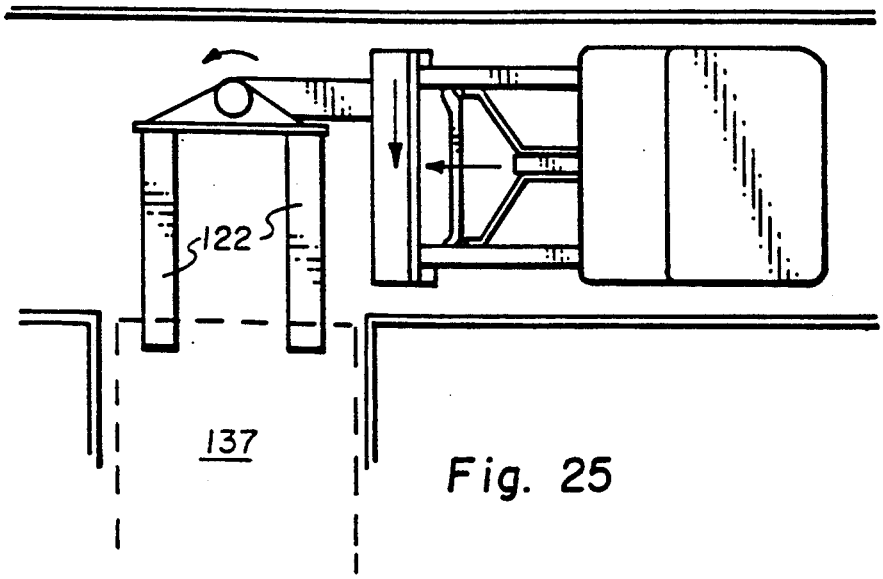
FIG. 25 is a top plan view of the lift truck of FIG. 24 showing an advancement of the longitudinal extension or displacement of the mast (indicated by arrow) in association with the further advancement of the counterclockwise angular rotation (as shown by an arrow). The forks have been rotated to face approximately ninety (90) degrees from the orientation shown in FIG. 23. The carriage is also shown being displaced to the left (as indicated by an arrow).

FIG. 25 shows the forks 122 being rotated into an aligned position in registration with the article to be loaded. Observably, in FIG. 25, the rolling mast arrangement of the truck has been extended to bring the carriage 120 in full alignment with the article 137. Noticeably, the chassis 32 of the truck has remained stationary during the entire maneuver.

Subsequent to the alignment of the carriage 120 as shown in FIG. 25, the forks 122 are inserted beneath the article 137 by a translation of the support bracket 108 across the face of support 90 by cylinder 92.

Figure 26:
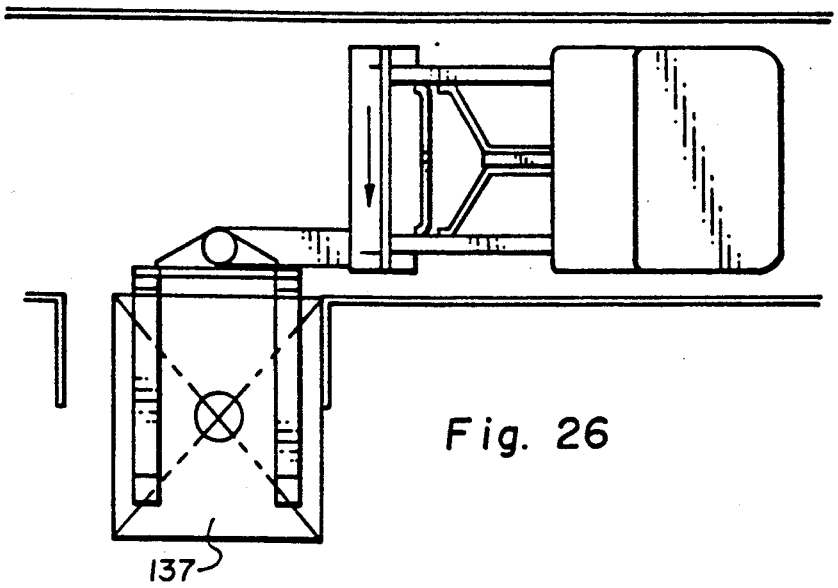
FIG. 26 is a top plan view of the lift truck of FIG. 23 showing the forks being further shifted laterally from an orientation ninety degrees (90°) removed from the position shown in FIG. 23, bringing the forks into position beneath a shelved load to be lifted.
Figure 27:
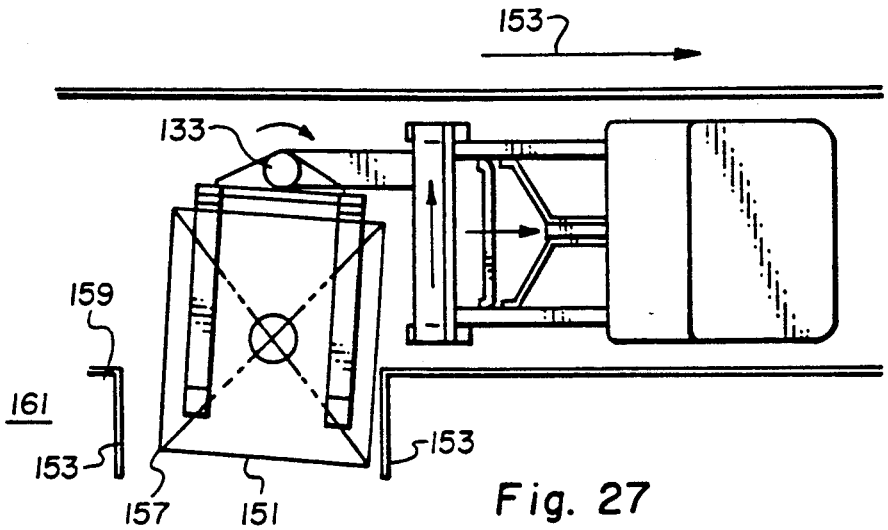
FIG. 27 is a top plan view of the lift truck of FIG. 23 showing the carriage being shifted laterally to the right (indicated by an arrow). The figure further illustrates a clockwise rotation of the carriage, as indicated by an arrow. The mast is also depicted, by an arrow, as being retracted toward the truck carriage.

At this juncture, i.e. in the orientation shown in FIG. 26, the forks 122 are elevated by a vertical extension of mast 57, thereby lifting and loading the article 137 onto the forks 122. In the condition shown in FIG. 27, cylinders 126 may be actuated to pivot forks 122 about their horizontal axes 141, thereby tipping the article 137 into a more securely loaded position by urging the article 137 against the vertical sections 143 of the forks 122.

Figure 28:
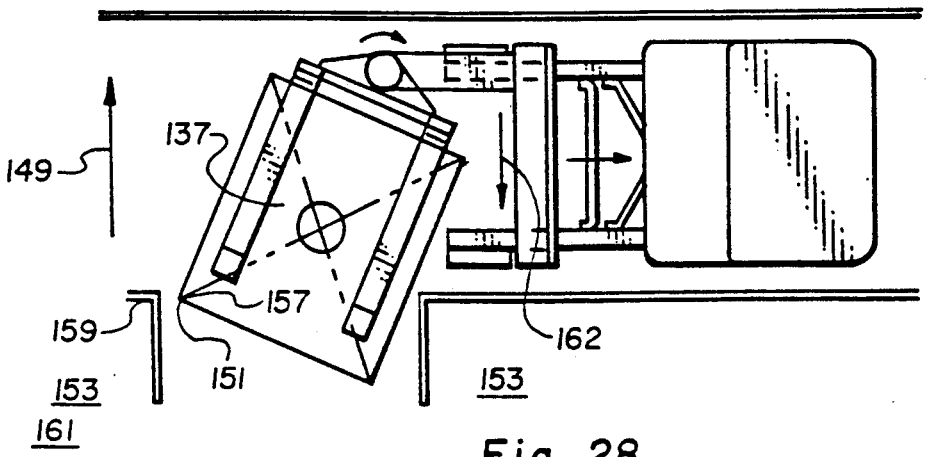
FIG. 28 is a top plan view of the lift truck of FIG. 23 showing a clockwise rotation of the carriage, shown by an arrow. A retraction of the mast toward the truck chassis is illustrated by the arrow. The lateral displacement of the carriage to the left is also shown.
Figure 29:
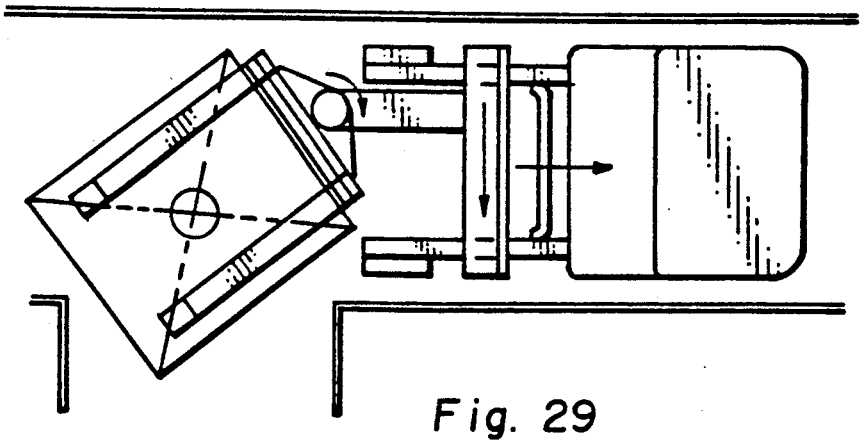
FIG. 29 is a top plan view of the lift truck of FIG. 28 showing an advancement of the combined rotation and longitudinal displacement shown initiated in FIG. 28.

Once the article is securely retained on forks 122, the support bracket 108 is displaced in the direction indicated by arrow 149 (FIG. 28) by the action of cylinder 92. The end 151 of article 137 begins to approach the front faces of adjacently positioned articles 153. The carriage is rotated about axis 133 while simultaneously, the rolling mast 57 is retracted in the direction indicated by arrow 153, bringing the mast 57 closer to the truck chassis 32.

As the corner 157 of the article 137 clears the corner 159 of adjacent article 161, support bracket 108 is translated in the direction of arrow 162 along the face of support 90, until reaching the central or midpoint of support 90. Furthermore, the mast 57 is displaced toward the chassis 32. Simultaneously, the carriage continues its rotation about axis 133 until the article is brought into the forward facing orientation shown in FIG. 30.

The truck effectively utilizes the spacing between adjacent shelved articles for rotating the article to be transported and displacing it toward the truck chassis during the loading process. This utilization permits the operator to begin the rotation and displacement of the article prior to the article having been completely removed from the shelf space. This permits the operator to orient the article on the truck in a position for its transport in a spatial area considerably smaller than that required by either turret or rolling mast trucks.

Figure 31:
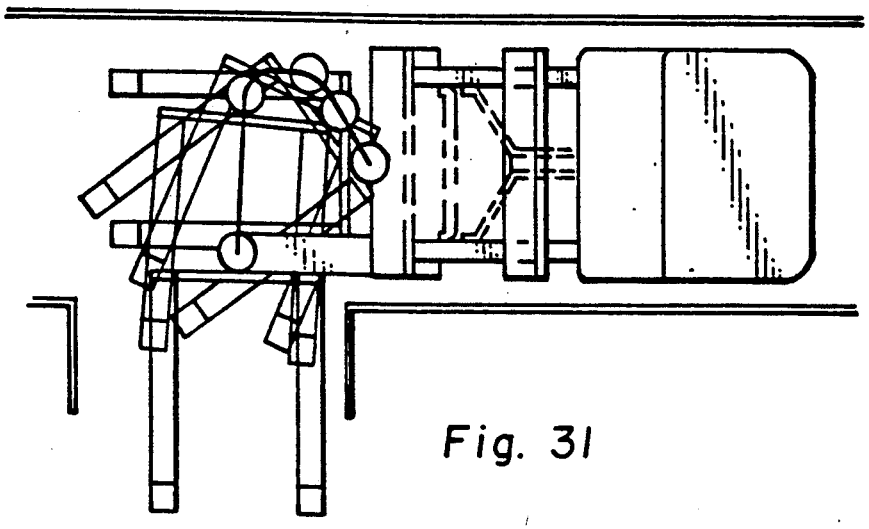
FIG. 31 is a top plan view of the lift truck of FIG. 23 showing a plurality of fork and carriage orientations through which the fork and carriage pass during a typical loading operation.

FIG. 31 illustrates in a time-lapse format the path of the carriage 120 from its initial outwardly directed orientation to its ninety degree rotation. The path of the circular carriage pivot during the reorientation parallels the path of the center of gravity of the carriage during loading. Whereas in contrast to the essentially linear translation of that center of gravity, discussed in the description of the prior art lateral shifting truck of FIGS. 8-9, the path of the center of gravity in the inventive truck follows a generally "J"-shaped curvilinear path which retains the center of gravity closer to the chassis during the loading and unloading operation.

Figure 30:
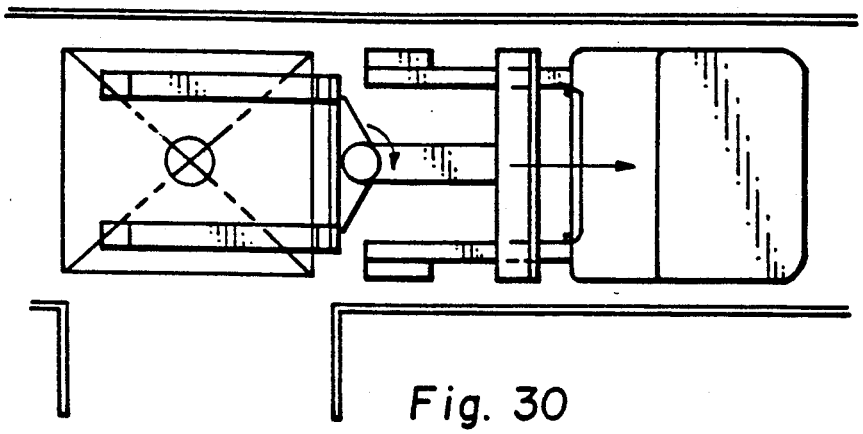
FIG. 30 is a top plan view of the lift truck of FIG. 23 showing the forks and load in an orientation suited for transport.
Figure 32:
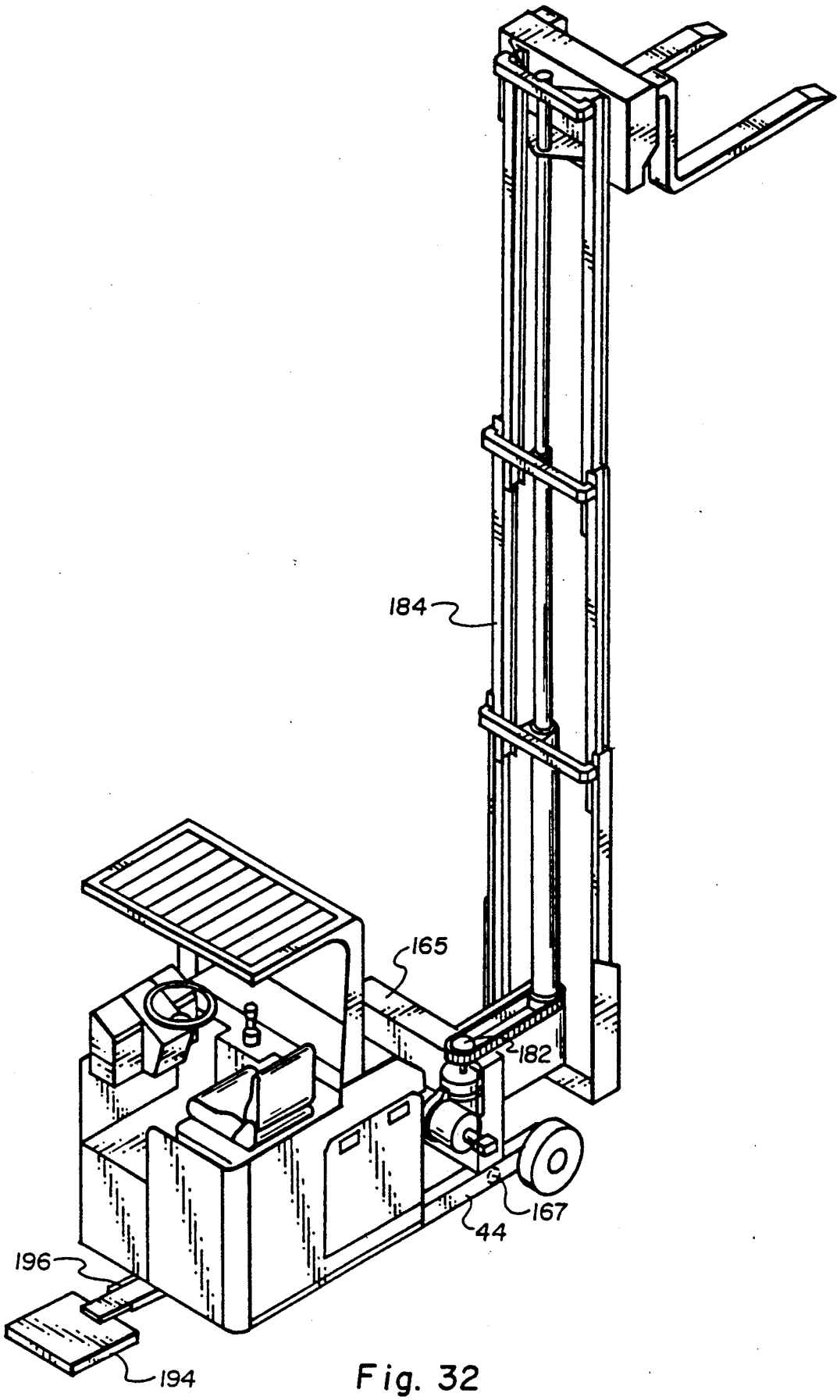
FIG. 32 is a perspective view of a third embodiment of the invention.
Figure 33:
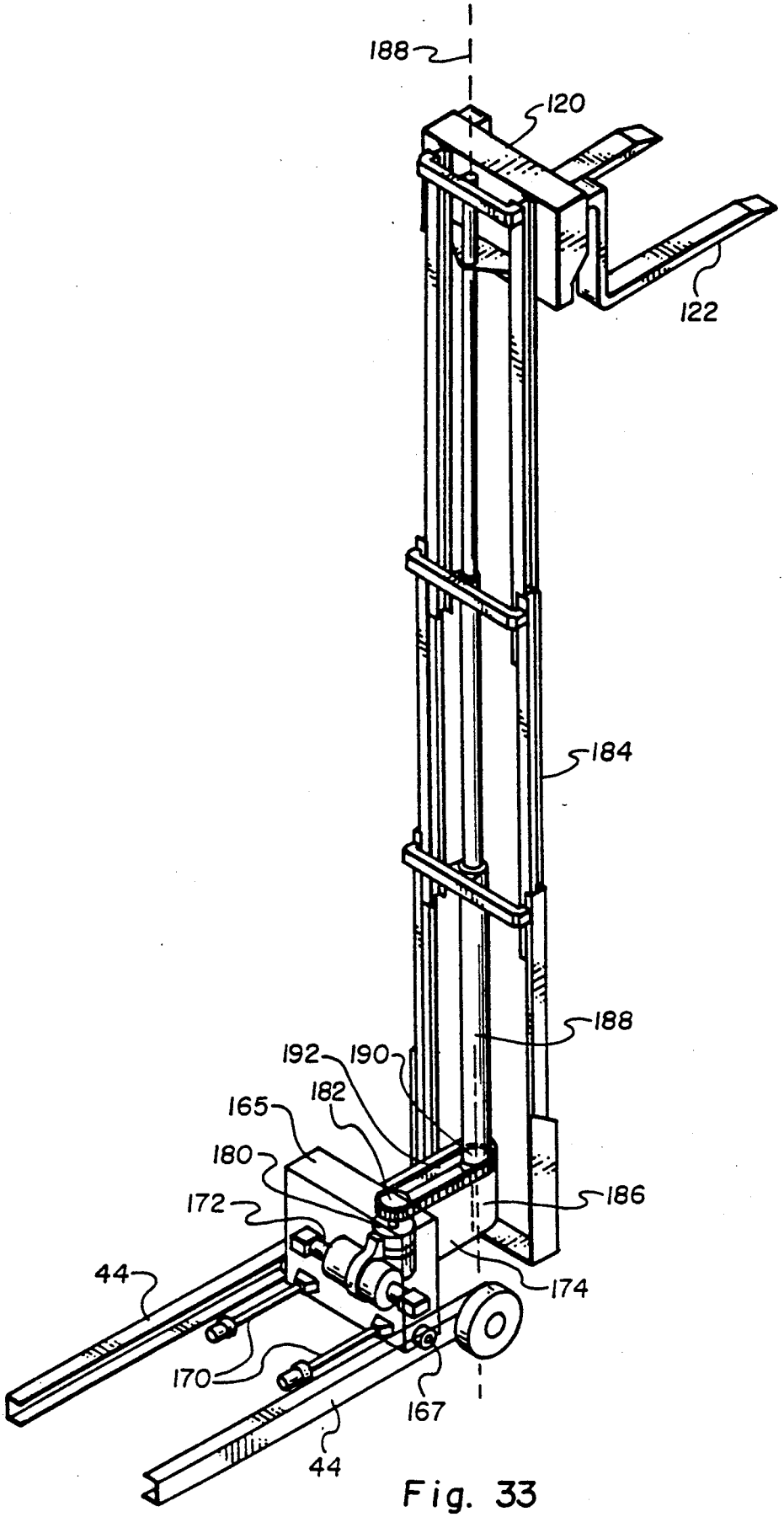
FIG. 33 is a sectional view of the embodiment illustrated in FIG. 32.

FIG. 32 and 33 illustrate a second embodiment of the invention. In this embodiment, a support 165 is mounted to be slidably displaceable along a length of the outrigger supports 44. As shown in FIG. 30, the support 165 includes rotatably mounted wheels 167 mounted on the opposing ends thereof, dimensioned to be received within a guide track formed by a structural member, e.g. a "C"-shaped construction of each of the outrigger supports 44. The support 165 is fitted with one or two dual-directioned pressurized fluid cylinders 170, which are mounted on their first end to the support 165 and at their opposing ends to the chassis 32. Being dual directioned, the cylinders 170 are adapted to slide the support 165 longitudinally back and forth along a selected length of the outrigger supports 44.

A dual-directioned pressurized fluid cylinder (e.g. a pneumatic cylinder) 172 is mounted horizontally on support 165. An outwardly protruding extension 174 is mounted on cylinder 172. The cylinder 172 is adapted for translating the extension 174 laterally across the face of support 165 in a reciprocating motion. Extension 174 is fitted with a hydraulic motor 180 oriented upright such that its drive shaft is vertically oriented. A toothed gear 182 is mounted on that drive shaft in a generally horizontal orientation.

A vertically extending mast 184 is pivotedly mounted to extension 174 by means of a vertically oriented, elongate pivot pin 186. The mast 184 is mounted to be angularly rotatable about a vertical axis 188. A toothed gear 190 is mounted on pivot pin 186 in a generally horizontal orientation. The gears 190 and 182 are mechanically intercooperated by means of an endless drive chain 192 which is trained about the two gears. The chain operates to translate an hydraulic motor-induced angular rotation of the gear 182 to cause a corresponding rotation of mast 184.

In other respects, the construction of the mast 184, including its extendibility function and the pressurized fluid cylinder adapted for raising and lowering the mast, are similar structure-wise to the aforedescribed mast structure 64. The carriage 120 may likewise be fitted with one or more cylinders 176 adapted for fitting the forks 122, as previously described.

Operationally, this second embodiment in large part duplicates the various movements previously described above appertaining to the first embodiments.

The truck may also be fitted with a means of physically displacing a portion of the chassis' mass, thereby modifying the moment of inertia created by the chassis about either the longitudinal or lateral axis of rotation. As shown in FIG. 32, a weight 194 is slidably mounted in a guide track 196 mounted within the chassis 32 of the truck. The weight 194 is displaced along the track 196 either toward or away from the chassis in response to moments created on the truck by the imposition of loads on the carrying forks 122. By adjusting the location of the weight 194, the operator is able to effectively control the length of the moment arm of that weight 194 and thereby adjust the magnitude of the moment created thereby about the relevant rotational axis. Observably, the truck may be fitted with more than one such weight. For example, one weight could be oriented to be directed longitudinally from the truck while a second weight is oriented for lateral displacement. Alternatively, a weight having two degrees of freedom maneuverability could also be utilized. The displacement of the weight 194 is controlled by a conventional linkage which extends to a location proximate the operator's seat.

Figure 18:
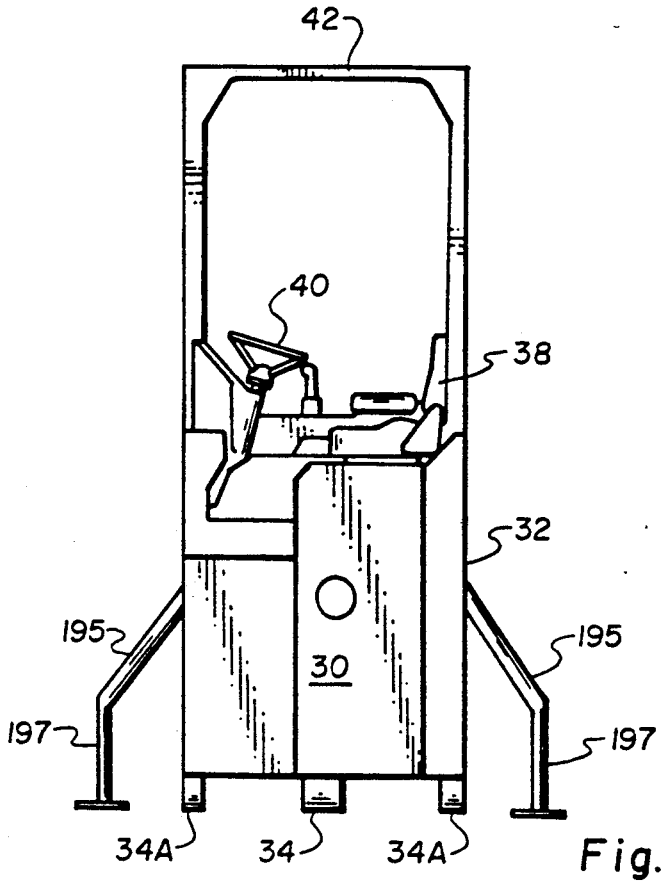
FIG. 18 is a rear view of the lift truck shown in FIG. 16 with the mast and lifting forks removed.
Figure 19:
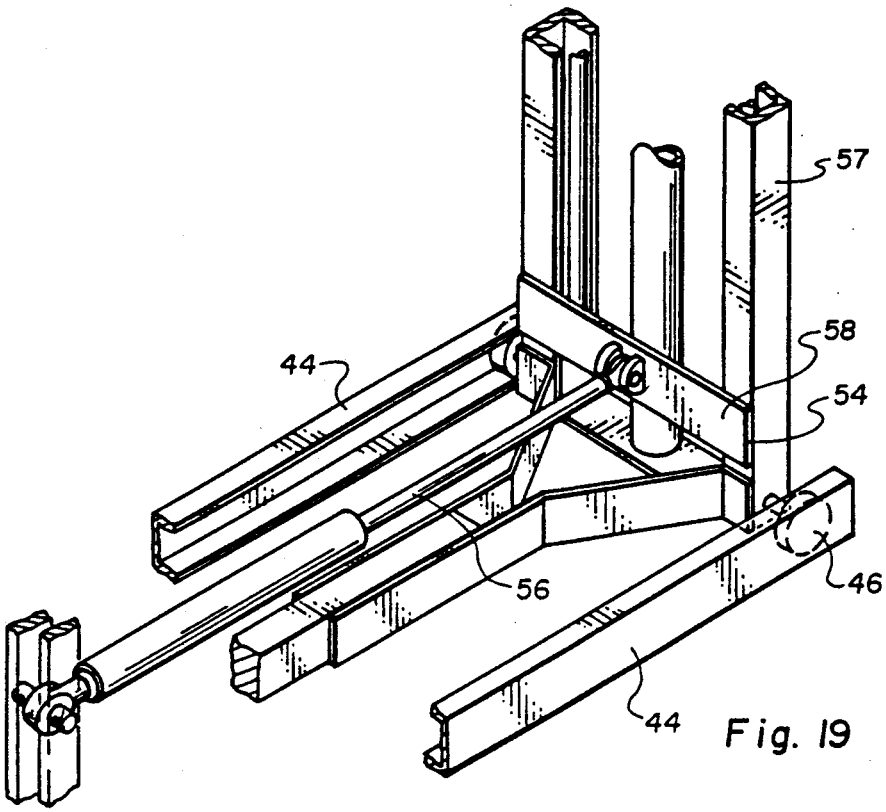
FIG. 19 is a perspective sectional view of the rolling mast of the lift truck of FIG. 16.
Figure 20:
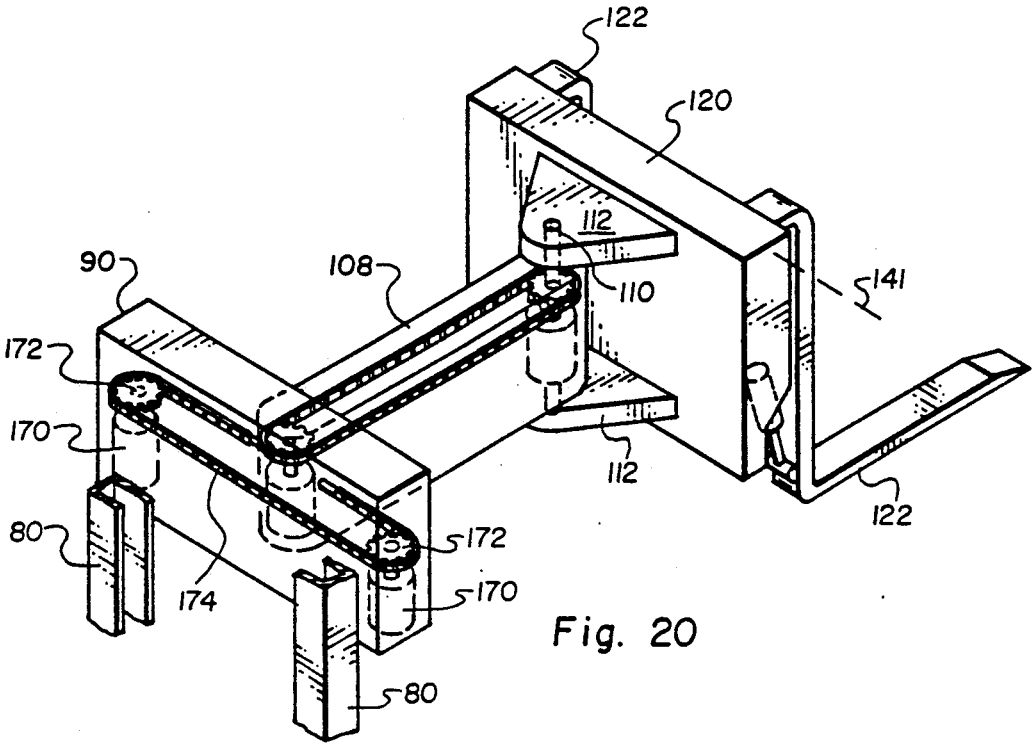
FIG. 20 is a perspective sectional view of the forks and support carriage of the lift truck of FIG. 16.

FIGS. 16 and 18 illustrate an alternative stabilizing means 195 wherein an articulated stabilizing arm 197 is mounted to each of the sides of chassis 32. As shown, each arm is fitted with a pressurized fluid cylinder adapted to engage the ground on either side of the chassis. Each arm 197 is adapted to exert a reactive force on the chassis and thereby steady the chassis by applying a lateral moment thereto.

Longitudinal stability is an essential characteristic of lift trucks. The conventional reach truck is designed to ensure longitudinal stability by controlling the location of a load's center of gravity (hereinafter "load center") vis-a-vis an axis of rotation of the truck. In the truck construction depicted in FIGS. 4 and 7, the truck's axis of rotation 200 during load retrieval is collinear with the axis of the truck's front wheels. When a load is placed on the truck's forks, with the mast in its most forward location (as occurs during initial retrieval of a load from its shelf location), the load 201 creates a clockwise directed movement of inertia 202 about the rotational axis 200 (see FIG. 7). The chassis creates an opposing counterclockwise directed moment of inertia 204 about the rotational axis which counteracts the moment generated by the load. As long as the moment created by the chassis is larger than that created by the load, the truck remains stable. If the load created moment becomes larger than that created by the chassis, the truck overturns. The design of the reach truck permits the user to physically move the load center (CGL) toward the chassis by operating the rolling mast, preferably positioning that load center on the chassis side of a vertical plane which passes through the rotational axis, eliminating any load-created, clockwise-directed moment about the rotational axis. In this preferred orientation, the weight of both the load and the chassis is supported by all of the wheels or supports of the truck, which condition contributes to longitudinal stability.

While the design of the reach truck contributes to enhancing a lift truck's longitudinal stability, it simultaneously requires a relatively wide aisle to facilitate the truck's maneuvering for its retrieval and unloading operations. The reach truck must make a ninety degree (90°) turn within the width of the aisle during both retrieval and unloading. In the truck's loaded condition, the total loaded length of the truck composed of the actual length of the truck plus a portion of the length of the load, is oriented within the aisle substantially perpendicular to the longitudinal axis of that aisle. It follows that for the truck to maneuver to a position whereby the truck can proceed longitudinally, i.e., a 90° turn, the aisle must be dimensioned to be considerably wider than the truck's loaded length. In conventional constructions, the length of a lift truck is dimensionally larger than the truck's width.

Compared the reach truck, the particular design and operation of a turret truck reduces the width of the aisle required for a truck's operation but does not produce the longitudinal stability inherent in the reach truck design. As shown in FIG. 11, a turret truck retrieves a load by the lateral shifting of its load forks. As the truck initially lifts its load, the load creates a moment of inertia 209 about a longitudinally extending axis of rotation 210 which extends along the left or right side of the truck, depending on which side the load is located. The moment is opposed by a moment 211 created by the weight of the chassis about that axis 210 (see FIG. 11). Lateral stability is ensured provided the chassis created moment exceeds the load created moment. After initially retrieving its load, the turret truck displaces the load center toward the longitudinal axis of the truck, thereby enhancing lateral stability. Upon the load center's displacement through a vertical plane passing through the axis of rotation, i.e. on the chassis side of the aforesaid plane, the load and chassis are supported by all of the truck's wheels, thus achieving lateral stability. The turret truck carries its load along the aisle with its forks directed laterally as shown in FIG. 10.

The turret truck does not include means of enhancing the truck's longitudinal stability. As shown, the load center is positioned on the non-chassis side of a vertical plane passing through the front axle of the truck. Resultingly, the load creates a counterclockwise directed moment about an axis of rotation 213 oriented collinear with the front axle. The turret truck has no means of eliminating this moment by moving the load center through the vertical plane passing through the truck's front axle.

Figure 8:
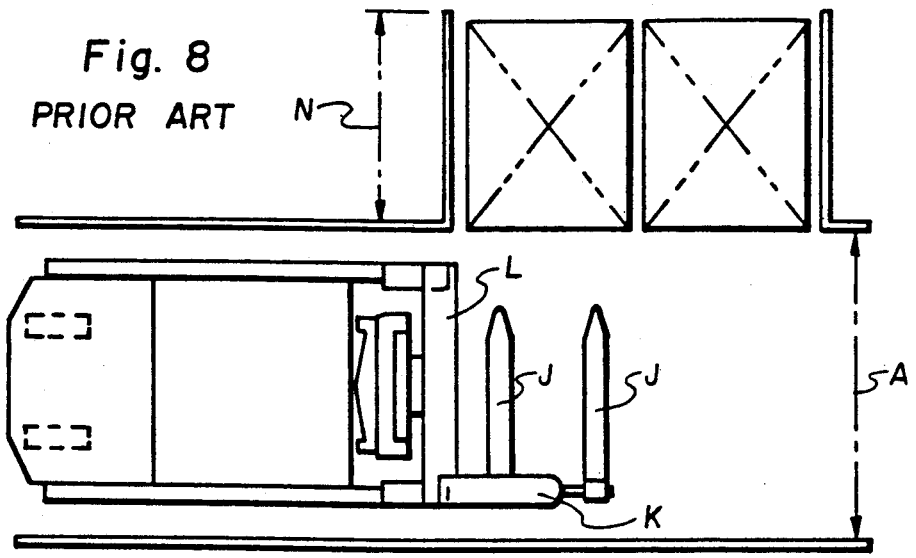
Fig. 8 PRIOR ART
FIG. 8 is a top plan view of a prior art lateral lifting truck positioned in an aisleway.
Figure 9:
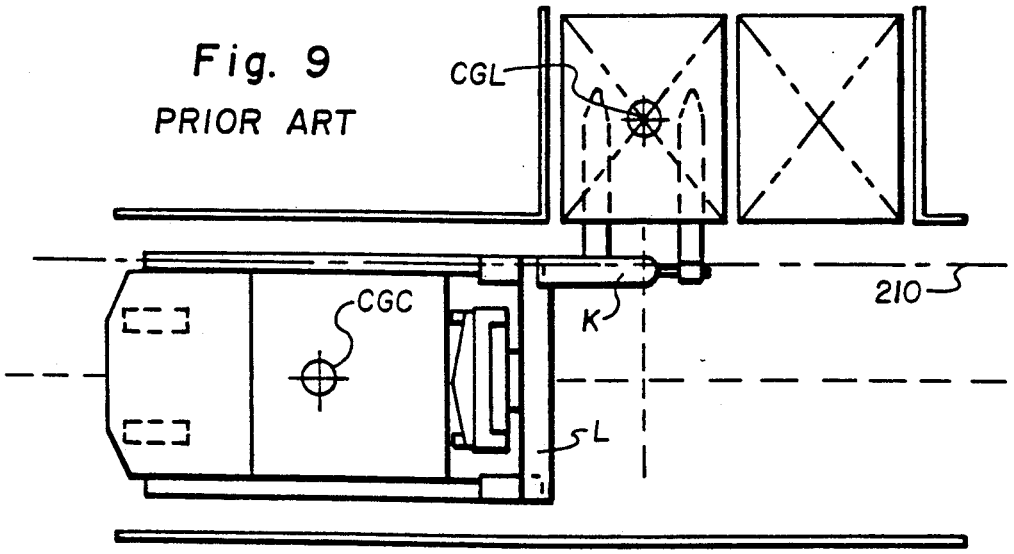
Fig. 9 PRIOR ART
FIG. 9 is a top plan view of the truck of FIG. 8 showing its lifting forks being inserted beneath a shelved load to be lifted.
Figure 10:
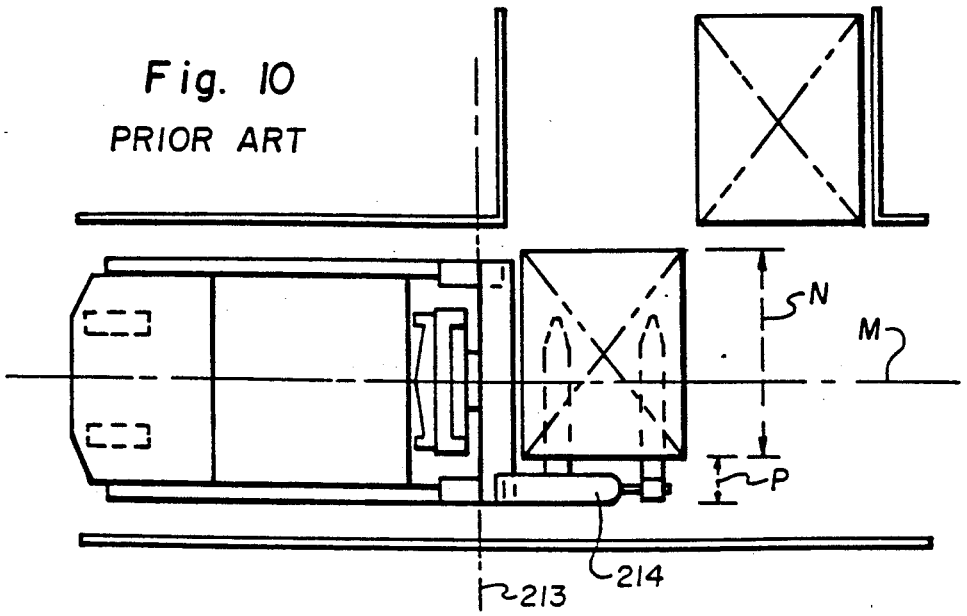
Fig. 10 PRIOR ART
FIG. 10 is a top plan view of the truck of FIG. 8 showing the load being retracted perpendicularly from its shelf location and positioned for travel longitudinally down the aisleway.

The turret truck's operation requires an aisle having a width which exceeds the total length of the load (N) plus the dimension (P) of the pivot head 214 of the forks (see FIG. 10).

In contrast to the prior conventional lift truck configurations, the instant invention provides a means of enhancing both the longitudinal and lateral stability of a loaded truck while simultaneously reducing the width of the aisle required for a lift truck's loading and unloading operation.

Figure 34:
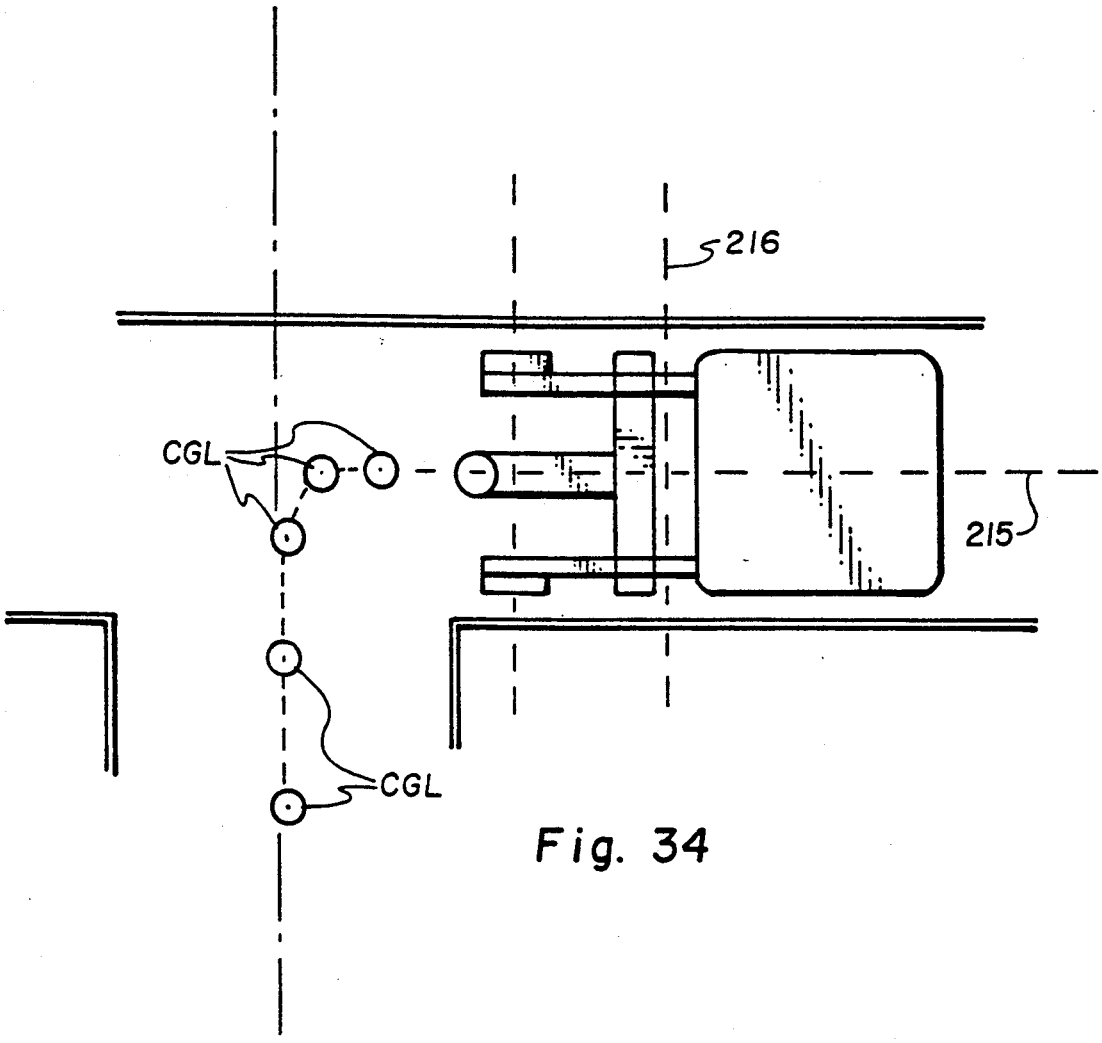
FIG. 34 is a top view of the truck of the invention illustrating the path of the load's center of gravity during the loading operation.

As described, the new truck permits an operator to move the article's load center subsequent to initial loading to a location on the chassis side of both the lateral as well as the longitudinally extending axes of rotation, thereby bringing that load center sufficiently proximate the longitudinal axis 215 (FIG. 34) and lateral axis 216 of the truck so as to render the truck longitudinally and laterally stable on its support wheels. Stated otherwise, the load center is positionable by the lift truck with an area outlined by the triangle or quadrilateral whose corners are defined by the various ground engaging wheels of the truck. (See dotted line representation in FIG. 24.) As a result, the instant invention provides a means of advancing longitudinal as well as lateral stability by selected displacement of the load.

Further, the inventive truck requires considerably less aisle width to load, transport and unload an article than conventional trucks. As illustrated, the instant truck due to its capability to simultaneously utilize its four degrees of freedom maneuverability, can effectively utilize the clearance between adjacent articles or rack members' space of an open shelf during the initial phases of the unloading procedure, thereby enabling the operator to complete either a retrieval or unloading operation in an aisleway which is only slightly larger than the width of the article to be transported.

To give some further meaning to these considerations, it is important to consider that an average pallet supported load is generally 40" wide by 48" deep in dimension. A reach truck having a length of approximately 80" typically requires an aisleway width of 7.5–8.0 ft. in order to properly load, transport and unload the pallet supported load. The carriage mechanism of a turret truck is typically approximately 56" wide, resulting in the requirement of an aisleway of at least 66–68 inches in width in order to ensure its proper operation. Should the operator want to unload an article from one shelf and unload it onto a shelf on the other side of the aisle, due to the turret truck's particular operation of carrying a load in a side-facing orientation and the close tolerances between the shelves on either side of the loaded truck, the turret truck operator must actually exit the aisle before rotating the load 180° to facilitate the unloading of the load into the shelf facing the shelf from which the load was retrieved unless the aisle is wider than 72 inches. Since few warehouses are disposed to provide such additional end aisle space, the conventional approach is to provide a truck for each aisle, i.e. an aisle-captive truck. Alternatively, the load must be positioned at a height and location which would allow rotation of a turret to extend into openings to allow rotation within the confines of the aisle in a 68" aisle. A turret truck cannot rotate a load from one side to another. Not only is the operation time consuming, but furthermore, the space required at the end of the aisle to provide sufficient maneuverability of the rotating forks is substantially in excess of that required for the operation of other types of trucks having the ability to shift the directions of a loaded article while the truck is within the aisle. Further, the turret truck, in carrying the load such that its length is oriented laterally, of necessity requires a turning radius which is substantially in excess of the turning radius of the truck in which the load is carried with its length oriented longitudinally. As a result, while the design and operation of a turret truck may reduce the requisite aisle width somewhat, that benefit is offset by the need for additional space at the ends of each aisle. This additional space is required due to the longer length chassis which a turret typically includes. In those instances wherein the turret truck pivots the load for transport to a forward facing orientation (see solid line representation of FIG. 12), the truck suffers a loast load center of 24–28 inches.)

Figure 12:
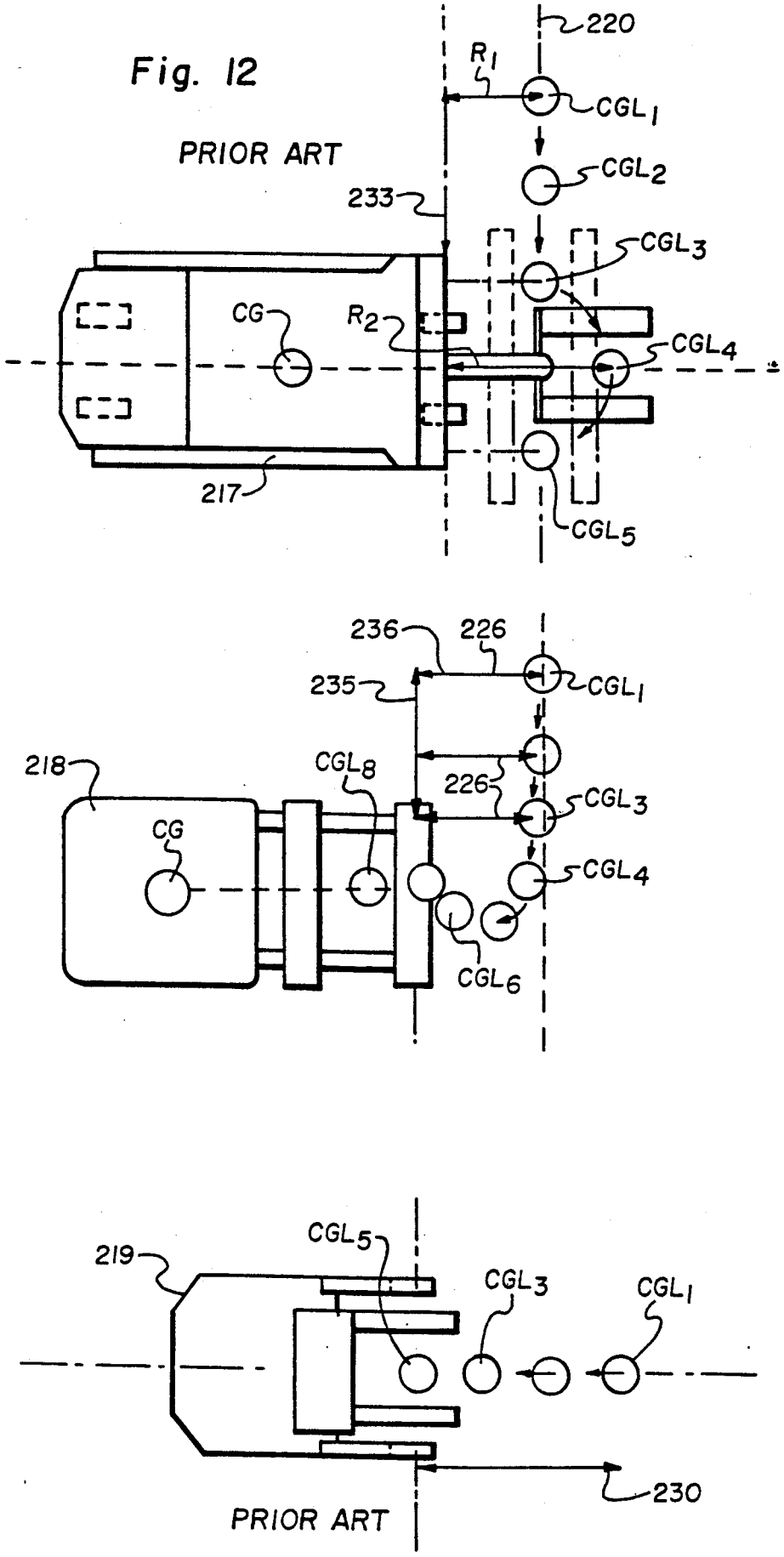
Fig. 12 PRIOR ART
FIG. 12 is a top view of respectively a turret truck, a truck of the invention and a rolling mast reach truck.

FIG. 12 permits a comparison of the longitudinal and lateral stability of a turret truck 217, a truck of this invention 218 and a reach truck 219. For each truck, the circles labeled CGL indicate the location of the center of gravity of a load during the operation of unloading an article from a shelf and into an orientation for transporting the load.

Regarding longitudinal stability with the turret truck, the load center progresses along a laterally extending linear path 220 until reaching approximately the edge of the chassis. At that point, the load is shifted generally along a semicircular path to the orientation depicted as $CGL_4$. The location identified as $CGL_4$ is the location in which the load is retained during transport. Noticeably, the moment arm 224 of the load's center of gravity remains essentially constant between the locations identified as $CGL_1$ through $CGL_3$. Between $CGL_3$ and $CGL_4$ the length of that movement arm increases markedly. Understandably, any increase in that moment arm increases the moment created on the truck by the mass of the load. To determine the maximum mass of the load that can be stably loaded by the truck, the maximum moment arm length, i.e. $R_2$ must be determined and utilized to compute the maximum moment. Therefore, in the case of the reach truck, the load carrying capability is determined by analyzing the moment created at location $CGL_4$.

In the truck of the instant invention 218, the center of gravity of the load progresses along a generally "J"-shaped path, the upright leg portion of that "J"-shaped path being somewhat slanted. Noticeably, the moment arm 226 continuously decreases from a maximum length of location $CGL_1$, to a minimum length at $CGL_8$. Resultingly, the maximum longitudinally stable load carrying capability of the inventive truck is determined by analyzing the moment created at $CGL_1$.

In the case of the truck 219 the load-carrying capability is determined by analyzing the moment at $CGL_1$, i.e. moment arm 236.

Noticeably, the instant truck provides a construction having greater load carrying capability in that due to the path of the load during the loading and unloading operation, the longitudinal moment arm of the load is minimized in comparison with the turret and rolling mast trucks.

Regarding lateral stability, the moment arms 233 and 235 of the respective trucks 217 and 218 are substantially comparable, the reach truck 219 having generally little, if any, lateral stability problems.

The instant truck may be effectively operable in an aisleway having a width of approximately 54 inches. Understandably, this width reduction of 25% contributes to enhancing the quantity of warehouse space available for storage. In addition, the invention provides a truck having greater maneuverability and smaller or less loss load center.

It may be noted that the embodiments illustrated herein are merely illustrative of the application of the principles of the invention. Reference herein to details is not intended to limit the scope of the claims which themselves recite those features regarded as essential to the invention.

What is claimed is:

1. A lift truck comprising:

a chassis supported by wheels, said chassis having at least one outwardly extending outrigger mounted thereon, said outwardly extending outrigger being supported by a ground engagement means, said outwardly extending outrigger defining a first guide track;

a mast mounted on said outwardly extending outrigger guide track to be displaceable along a length of said first guide track;

first drive means mounted on said mast for displacing said mast longitudinally along said first guide track;

a support having a second guide track, mounted on said mast;

an extension mounted on said second guide track for lateral displacement along said second guide track;

a second drive means mounted on said support for displacing said extension along said second guide track, said second drive means being formed by a pair of hydraulic motors, each said hydraulic motor having a toothed gear mounted on a respective drive shaft thereof, said hydraulic motors being mechanically associated with one another by an endless chain trained over said toothed gears; and a carriage pivotedly mounted on said extension for rotation about a vertical axis, said extension including a third drive means adapted for angularly rotating said carriage about its said vertical axis relative to said extension, said carriage including a load-carrying fork means mounted thereon.

2. The lift truck according to claim 1 wherein said first drive means, said second drive means and said third drive means are operable simultaneously to maneuver said load-carrying fork means to a selected location and orientation.

3. The lift truck according to claim 1 wherein said fork means includes a tilting means for tilting and inclining said fork means assembly from a horizontal orientation.

4. The lift truck of claim 1 wherein said first drive means is a pressurized fluid cylinder.

5. The lift truck of claim 1 wherein said cylinder is a hydraulic cylinder.

6. The lift truck of claim 1 wherein said first driving means is an electric motor.

7. The lift truck of claim 1 wherein said second guide track is defined by a dual-directioned pressurized fluid cylinder.

8. The lift truck of claim 1 wherein said second drive means includes a hydraulic motor.

9. The lift truck of claim 1 wherein said mast is constructed to be vertically extendible and retractable, said mast including a fourth drive means mechanically associated therewith for drivingly extending and retracting said mast.

10. An industrial lift truck comprising:

an elongate chassis, supported by wheels, said elongate chassis having a pair of parallel, outwardly extending outrigger supports mounted thereon, each said outwardly extending outrigger support being supported by a wheel and defining an elongate longitudinally extending first guide track therein;

a nested, vertically extendible mast mounted on said outwardly extending outrigger supports, said nested, vertically extendible mast being slidably displaceably mounted in said first guide track;

a first dual-directional, pressurized fluid cylinder mounted on said elongate chassis to extend outwardly therefrom, said first dual-directional, pressurized fluid cylinder being mounted on said nested, vertically extendible mast to provide means of drivingly displacing said nested, vertically extendible mast back and forth along said first guide track;

a support mounted on said nested, vertically extendible mast, said support including a second pressurized dual-directional fluid cylinder mounted thereon;

an arm mounted on said second pressurized, dual-directional fluid cylinder, said arm extending outwardly from said support, said second pressurized, dual-directional fluid cylinder being oriented to displace said arm laterally and reciprocally along a face of said support;

a hydraulic motor mounted on said arm having a first toothed gear mounted on a drive shaft;

a carriage mounted on an axle, said axle being journaled on said arm for rotation about a vertical axis relative to said arm, said axle having a second toothed gear mounted thereon; and an endless chain trained over said first toothed gear and said second toothed gear, said hydraulic motor in association with said toothed gears, said endless chain and said axle forming a means of rotating said carriage about said vertical axis;

wherein said carriage includes a plurality of outwardly extending forks adapted for engaging, lifting, and transporting a load.

11. The lift truck of claim 10 wherein said carriage includes a plurality of third dual-directional pressurized fluid cylinders mounted thereon and said outwardly extending forks are pivotedly mounted to said carriage, said third pressurized dual-directional fluid cylinders being mounted to said outwardly extending forks to effect a tilting of said outwardly extending forks.

* * * * *